US011286129B2

(12) United States Patent
Tsujimoto et al.

(10) Patent No.: US 11,286,129 B2
(45) Date of Patent: Mar. 29, 2022

(54) SHEET SUPPLY DEVICE AND SHEET SUPPLY METHOD

(71) Applicant: ZUIKO CORPORATION, Osaka (JP)

(72) Inventors: Yoshiaki Tsujimoto, Osaka (JP); Hideki Fujita, Osaka (JP)

(73) Assignee: ZUIKO CORPORATION, Osaka (JP)

( * ) Notice: Subject to any disclaimer, the term of this patent is extended or adjusted under 35 U.S.C. 154(b) by 195 days.

(21) Appl. No.: 16/766,044

(22) PCT Filed: Nov. 29, 2018

(86) PCT No.: PCT/JP2018/043904
§ 371 (c)(1),
(2) Date: May 21, 2020

(87) PCT Pub. No.: WO2019/107472
PCT Pub. Date: Jun. 6, 2019

(65) Prior Publication Data

US 2020/0354181 A1 Nov. 12, 2020

(30) Foreign Application Priority Data

Nov. 30, 2017 (JP) ..... JP2017-231157

(51) Int. Cl.
*B65H 19/18* (2006.01)
*B65H 21/00* (2006.01)

(52) U.S. Cl.
CPC ..... *B65H 19/18* (2013.01); *B65H 21/00* (2013.01)

(58) Field of Classification Search
CPC ..... B65H 19/18; B65H 19/1815; B65H 19/1868; B65H 21/00
See application file for complete search history.

(56) References Cited

U.S. PATENT DOCUMENTS 4,518,127 A * 5/1985 Hurst ..... B65H 19/1873 242/555.4
4,948,061 A * 8/1990 Krimsky ..... B65H 19/1815 242/555.6

(Continued)

FOREIGN PATENT DOCUMENTS

CN 1600543 3/2005
CN 107381161 11/2017

(Continued)

OTHER PUBLICATIONS

International Search Report dated Jan. 15, 2019 in International (PCT) Application No. PCT/JP2018/043904.

(Continued)

*Primary Examiner* — Sang K Kim
(74) *Attorney, Agent, or Firm* — Wenderoth, Lind & Ponack, L.L.P.

(57) ABSTRACT

Provided is a sheet supply device capable of reliably joining sheets by accurately transmitting force for joining the sheets. A joining mechanism includes a pressing roller that presses a sheet of a supply side roll against the outer peripheral surface of a standby side roll; and a moving unit that supports the pressing roller such that the pressing roller is configured to approach and move away from the standby side roll supported by a support shaft disposed at a splice position in the radial direction of the standby side roll. The moving unit supports the pressing roller such that the center of the pressing roller is movable on a straight line passing through the center of a rotation shaft and the center of the support shaft disposed at the splice position.

8 Claims, 23 Drawing Sheets

(56) References Cited

U.S. PATENT DOCUMENTS

| | | | | |
|---|---|---|---|---|
| 5,152,472 | A * | 10/1992 | Spang | B65H 19/1815 242/554.2 |
| 6,764,040 | B2 * | 7/2004 | Kiyota | B65H 19/1821 242/554 |
| 7,156,340 | B2 * | 1/2007 | Shiraishi | B65H 19/1868 242/554.3 |
| 2005/0077417 | A1 * | 4/2005 | Shiraishi | B65H 19/1821 242/554.3 |

FOREIGN PATENT DOCUMENTS

| | | |
|---|---|---|
| JP | 1-220668 | 9/1989 |
| JP | 2002-265108 | 9/2002 |
| JP | 2002-338098 | 11/2002 |
| JP | 2003-118895 | 4/2003 |
| JP | 2009-143706 | 7/2009 |

OTHER PUBLICATIONS

Office Action dated Mar. 2, 2021 in Chinese Application No. 201880076143.7 with partial English translation.

* cited by examiner

SHEET SUPPLY DEVICE AND SHEET SUPPLY METHOD

TECHNICAL FIELD

The present invention relates to a sheet supply device for continuously supplying a sheet from a roll around which the sheet is wound.

BACKGROUND ART

Conventionally, for example, an unwinding device described in Patent Literature 1 has been known.

The unwinding device includes a rotation arm that is rotatably supported about a predetermined rotation shaft, a pair of chucking devices that is provided at a position away from the rotation shaft of the rotation arm in a direction orthogonal to the rotation shaft and holds respective rolls, and an automatic sheet joining device that joins a sheet of one roll (hereinafter, referred to as a supply side roll), which is supplying the sheet, to a sheet of the other roll (hereinafter, referred to as a standby side roll) among the rolls held on the chucking devices.

The rotation arm can be rotated between a standby position where one chucking device is disposed at a position where a new roll is mounted, and a splice position where the one chucking device is disposed at a position where the standby side roll is supported to join the sheet of the supply side roll.

The automatic sheet joining device is configured to press a middle part of the sheet of the supply side roll against an outer peripheral surface of the standby side roll when a remaining quantity of the sheet on the supply side roll becomes equal to or less than a preset remaining quantity.

Specifically, the automatic sheet joining device includes a lifting/lowering pressure roll that presses the sheet of the supply side roll against the outer peripheral surface of the standby side roll and a guide post that supports the lifting/lowering pressure roll such that the rotation arm is detachable from the standby side roll in a radial direction of the standby side roll in the state in which the rotation arm is rotated to the splice position.

However, in the opening winding device described in Patent Literature 1, the lifting/lowering pressure roll moves in a direction intersecting with a line connecting the rotation shaft and a center of the standby side roll in a state where the rotation arm is rotated to the splice position.

Therefore, there is a possibility that the rotation arm is rotated around the rotation shaft due to force received from the lifting/lowering pressure roll, and the rotation arm itself is bent. As a result, the transmission of the force from the lifting/lowering pressure roll to the standby side roll becomes insufficient, and it is difficult to reliably join the sheets.

CITATION LIST

Patent Literature

Patent Literature 1: JP 2003-118895 A

SUMMARY OF INVENTION

An object of the present invention is to provide a sheet supply device capable of reliably joining sheets by accurately transmitting force for joining the sheets.

In order to solve the above problem, the present invention provides a sheet supply device for sequentially supplying a sheet from a plurality of rolls around which the sheet is wound, the sheet supply device including: a rotation member that is rotatably supported about a predetermined rotation shaft; a plurality of support shafts that are each provided at positions away from the rotation shaft of the rotation member in a direction orthogonal to the rotation shaft and support the rolls at center positions thereof; and a joining mechanism that joins a sheet of a standby side roll different from a supply side roll to a sheet of the supply side roll which is supplying the sheet among the rolls supported by the support shafts, in which the rotation member is rotatably supported between a state in which one support shaft is disposed at a mounting position where a new roll is mounted, and a state in which the one support shaft is disposed at a splice position where the standby side roll is supported when the joining mechanism joins the sheets, the joining mechanism includes a pressing roller that presses the sheet of the supply side roll against an outer peripheral surface of the standby side roll and a moving unit that supports the pressing roller such that the pressing roller is configured to approach and move away from the standby side roll supported by the one support shaft disposed at the splice position in a radial direction of the standby side roll, and the moving unit supports the pressing roller such that a center of the pressing roller is movable on a straight line passing through a center of the rotation shaft and a center of the one support shaft disposed at the splice position.

In addition, the present invention provides a sheet supply method for supplying a sheet using the sheet supply device, the sheet supply method including: a mounting step of mounting the standby side roll on the one support shaft mounted on the mounting position; a supply step of supplying a sheet of a supply side roll supported by another support shaft other than the one support shaft, prior to the mounting step or after the mounting step; a splice preparation step of rotating the rotation member such that the one support shaft is disposed at the splice position when a remaining quantity of the sheet of the supply side roll is equal to or less than a preset remaining quantity; and a joining step of pressing the sheet of the supply side roll against an outer peripheral surface of the standby side roll and joining a sheet of the standby side roll to the sheet of the supply side roll by moving the pressing roller such that a center of the pressing roller moves on a straight line passing through a center of the rotation shaft and a center of the one support shaft disposed at the splice position.

According to the present invention, it is possible to reliably join the sheets by accurately transmitting the force for joining the sheets.

DESCRIPTION OF EMBODIMENTS

Hereinafter, embodiments of the present invention will be described with reference to the accompanying drawings. The following embodiments are specific examples of the present invention and do not limit the technical scope of the present invention.

Figure 1:
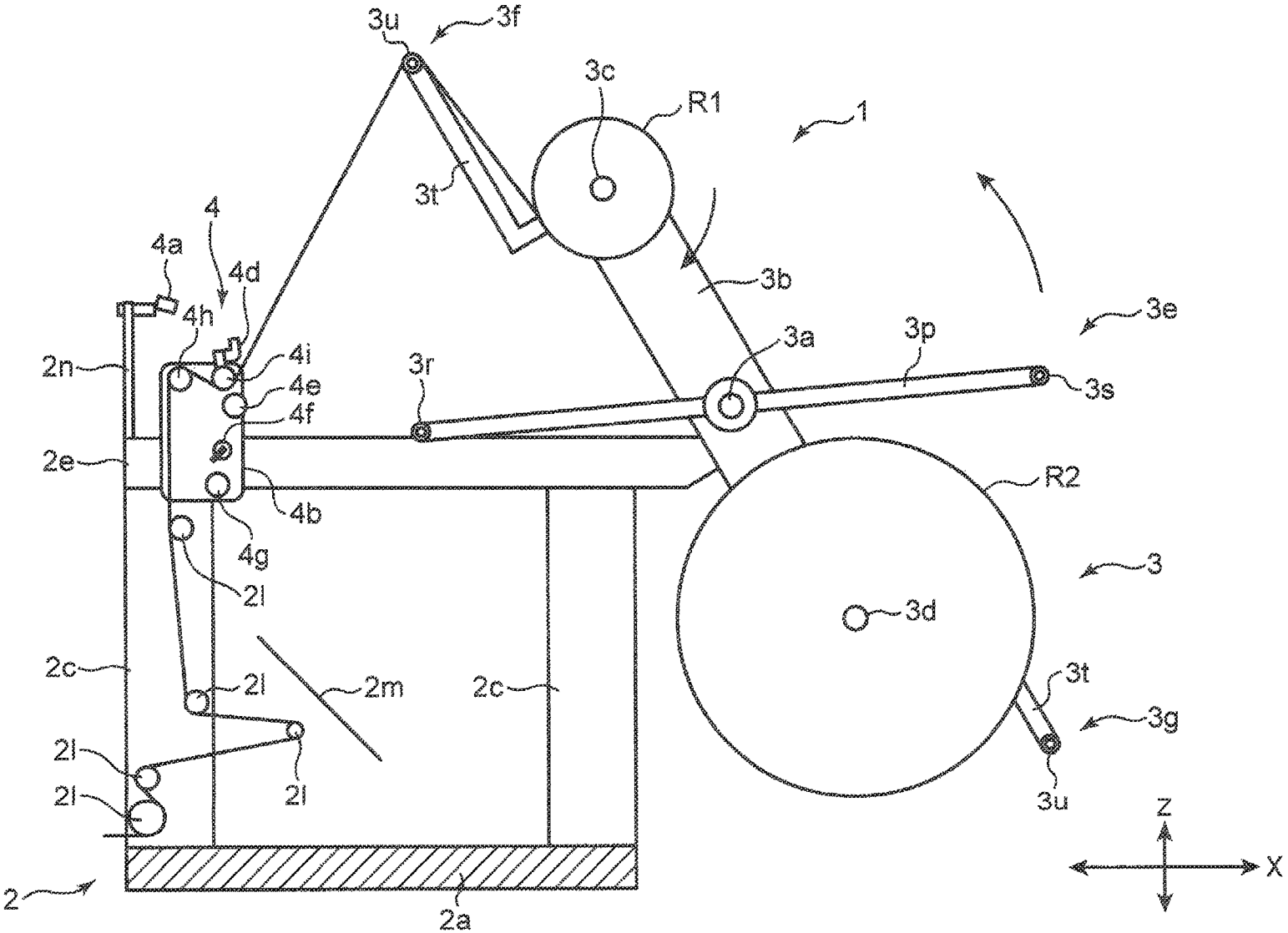
FIG. 1 is a partial front cross-sectional view of a sheet supply device 1 according to an embodiment of the present invention.
Figure 2:
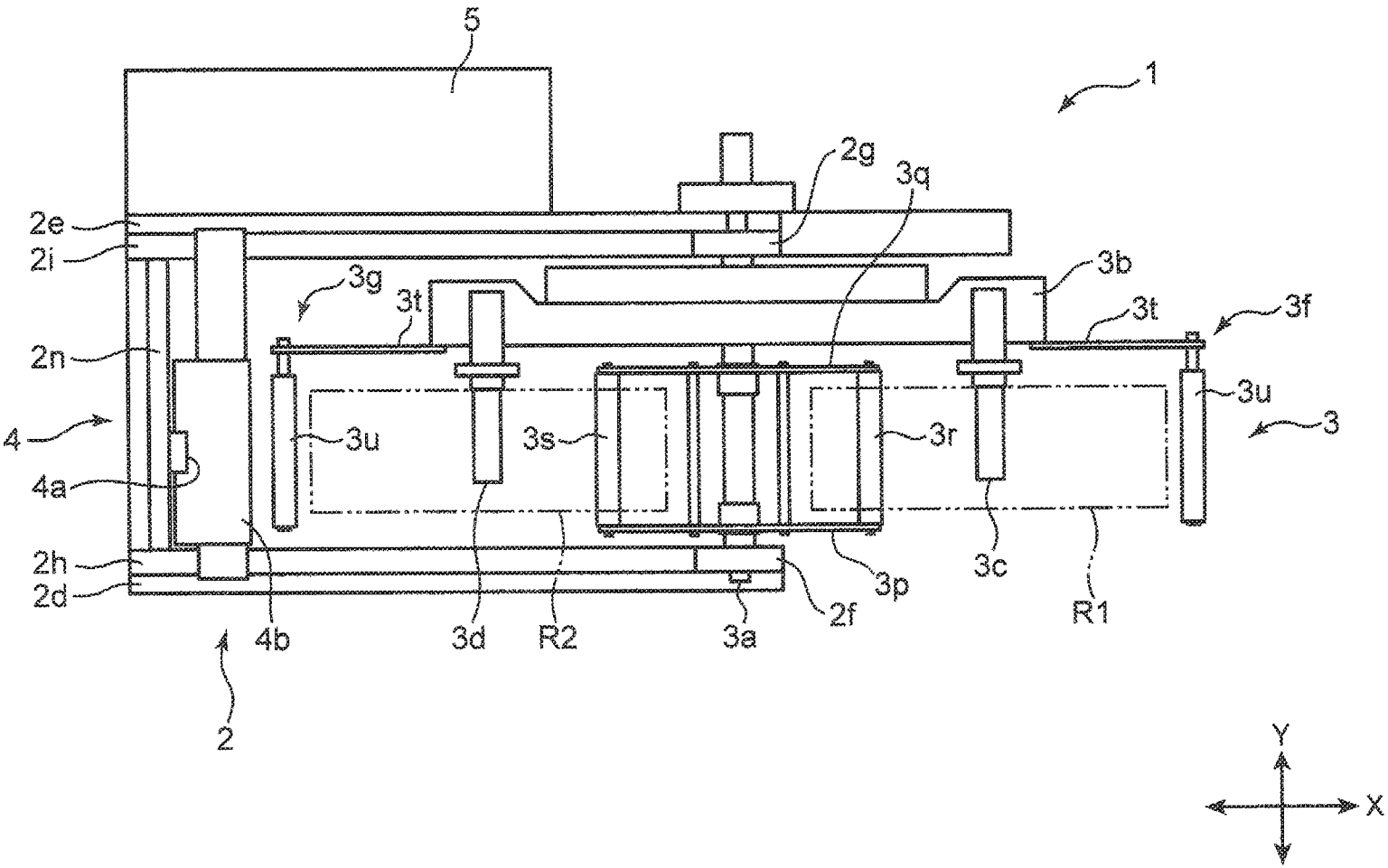
FIG. 2 is a plan view of the sheet supply device 1 of FIG. 1.
Figure 3:
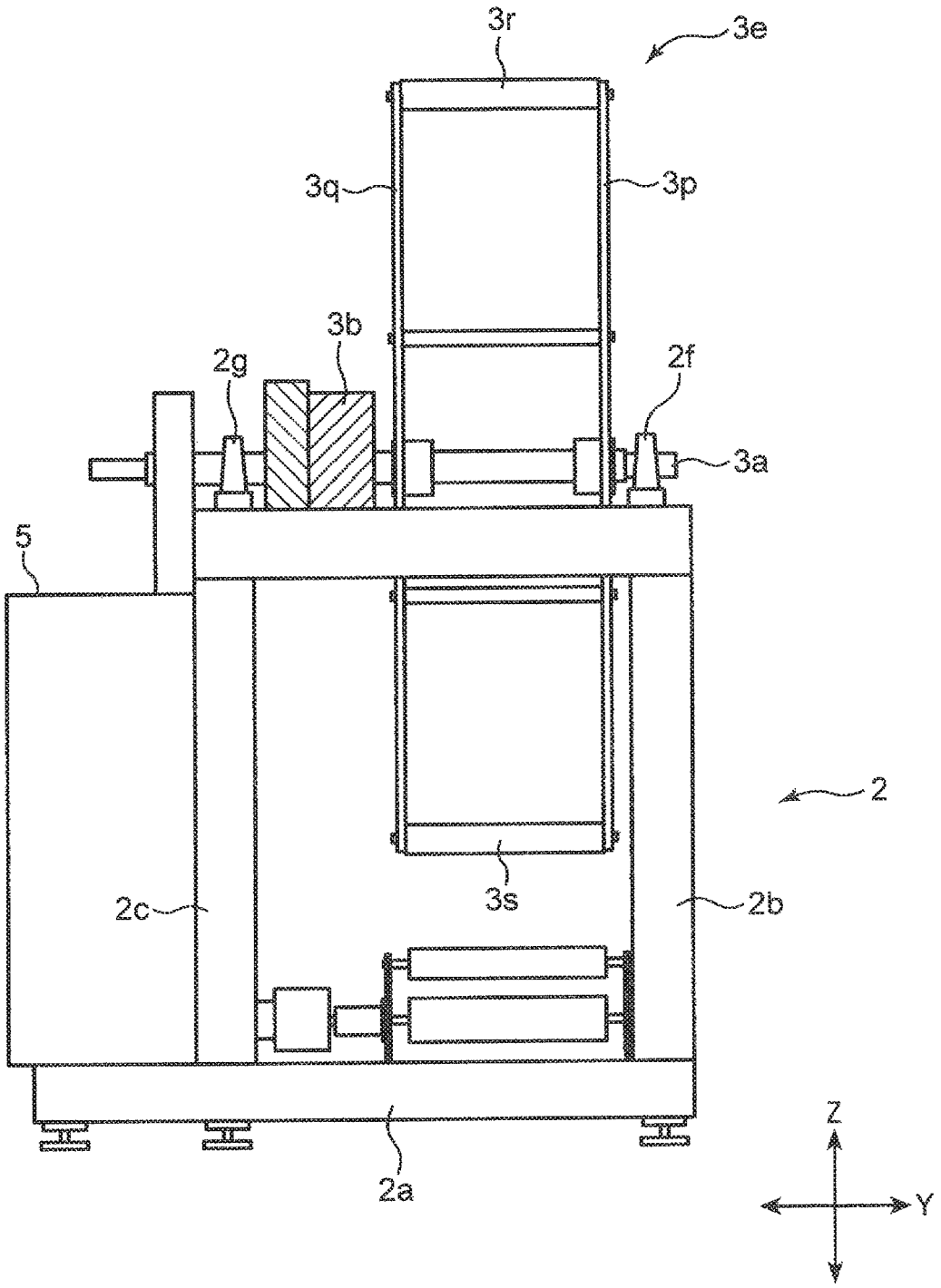
FIG. 3 is a side view of the sheet supply device 1 of FIG. 1.
Figure 4:
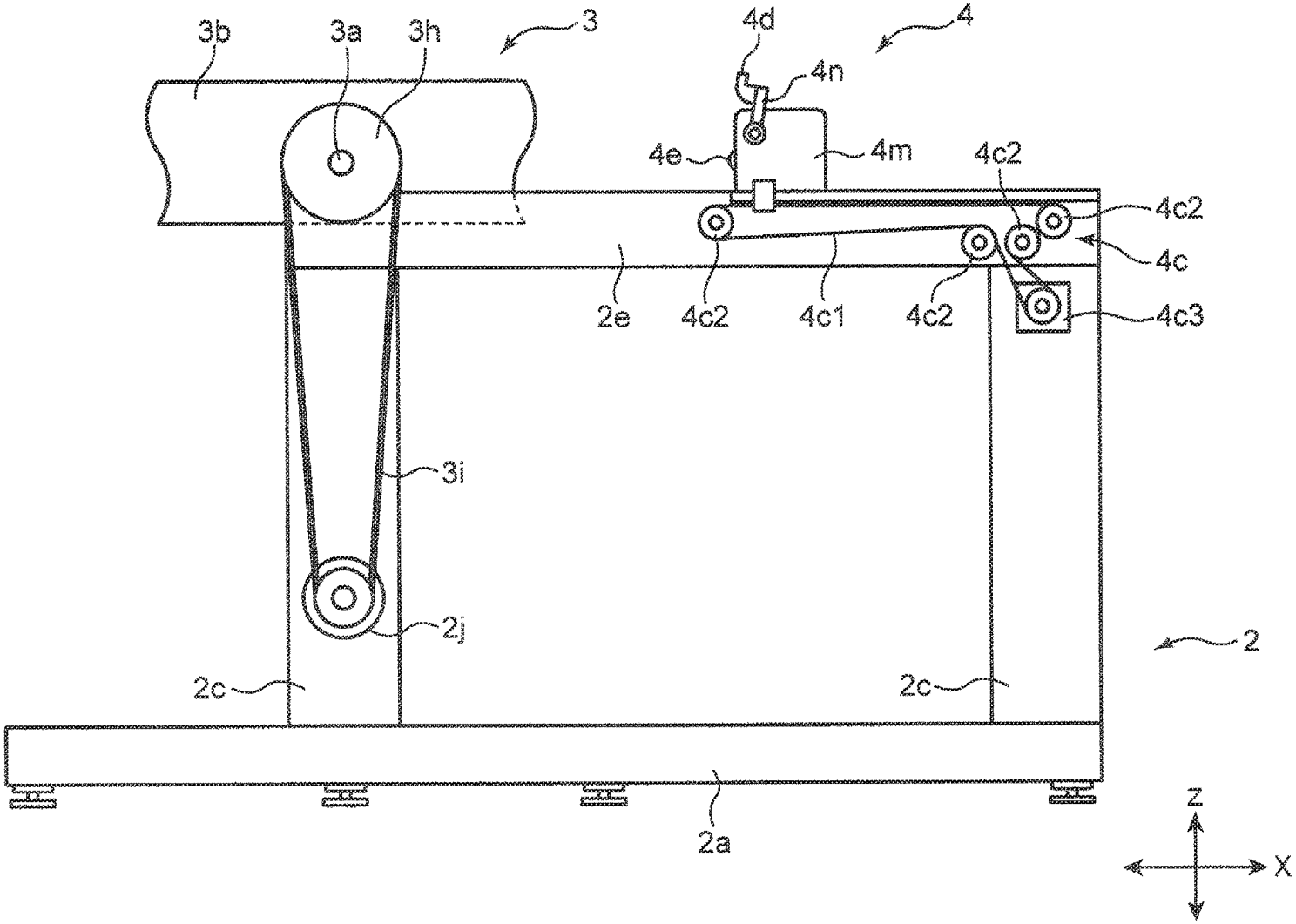
FIG. 4 is a rear view of the sheet supply device 1 of FIG. 1.

FIG. 1 is a partial front cross-sectional view of a sheet supply device 1 according to an embodiment of the present invention. FIG. 2 is a plan view of the sheet supply device 1 of FIG. 1. FIG. 3 is a side view of the sheet supply device 1 of FIG. 1. FIG. 4 is a rear view of the sheet supply device 1 of FIG. 1. Hereinafter, a horizontal direction in FIG. 1 will be described as an X direction, a vertical direction in FIG. 1 will be described as a Z direction, and a direction orthogonal to the X direction and the Z direction will be described as a Y direction.

Referring to FIGS. 1 to 3, the sheet supply device 1 is for supplying sheets from rolls R1 and R2 around which the sheets are wound.

Specifically, the sheet supply device 1 includes a base 2, a support mechanism 3 that supports the rolls R1, R2 while being attached to the base 2, a joining mechanism 4 that joins one sheet of one of the rolls R1 and R2 supported by the support mechanism 3 to the other sheet while being attached to the base 2, and a controller 5 that controls an operation of the support mechanism 3 and the joining mechanism 4.

The base 2 includes a mounting plate 2*a* mounted on a predetermined mounting surface, two columns 2*b* that stands on the mounting plate 2*a* so as to face each other in the X direction, two columns 2*c* that faces each other in the X direction at a position away from the two columns 2*b* in the Y direction, a beam 2*d* that extends in the X direction while being fixed to upper end portions of the two columns 2*b*, a beam 2*e* that extends in the X direction while being fixed to upper end portions of the two columns 2*c*, shaft support parts 2*f* and 2*g* (see FIG. 3) that stand on the beams 2*d* and 2*e*, respectively, and two rails 2*h* and 2*i* that extend in the X direction on the beams 2*d* and 2*e*. FIG. 1 is a partial front cross-sectional view in a state in which a part of the mounting plate 2*a* is cut away such that the illustration of the two columns 2*b* and the beams 2*d* are omitted.

The shaft support parts 2*f* and 2*g* face each other in the Y direction on one side (right side in FIG. 1) of the beams 2*d* and 2*e* in the X direction, while the rails 2*h* and 2*i* face each other in the Y direction on the other side (left side in FIG. 1) of the beams 2*d* and 2*e* in the X direction.

The support mechanism 3 is attached to the shaft support parts 2*f* and 2*g* of the base 2 so as to be rotatable about a rotation shaft 3*a* extending in the Y direction.

Specifically, the support mechanism 3 includes a rotation member 3*b* that is rotatably attached to the base 2 about the rotation shaft 3*a*, support shafts 3*c* and 3*d* that support the rolls R1 and R2 at center positions thereof, respectively, while being provided on the rotation member 3*b*, a rotating guide member 3*e* that is rotatably attached to the base 2 about the rotation shaft 3*a* together with the rotation member 3*b*, and adjacent guide members 3*f* and 3*g* that are provided adjacent to the support shafts 3*c* and 3*d*, respectively. The base 2 and the support mechanism 3 described above constitute a shaft support unit that supports the support shafts 3*c* and 3*d*.

The rotation member 3*b* extends between the beams 2*d* and 2*e* of the base 2 in a direction orthogonal to the rotation shaft 3*a*. In FIGS. 3 and 4, a part of the rotation member 3*b* is omitted.

The support shafts 3*c* and 3*d* are provided at positions away from the rotation shaft 3*a* in the rotation member 3*b* in a direction orthogonal to the rotation shaft 3*a*. Specifically, the support shaft 3*c* is provided at one end portion of the rotation shaft 3*a* in the rotation member 3*b*, while the support shaft 3*d* is provided at the other end portion of the rotation shaft 3*a* in the rotation member 3*b*. In addition, the support shafts 3*c* and 3*d* extend from the rotation member 3*b* to one side (beam 2*d* side) in the Y direction. As described above, the support shafts 3*c* and 3*d* are supported in a cantilever manner with respect to the rotation member 3*b*. Therefore, a worker can easily mount the rolls R1, R2 from near sides of free ends of the support shafts 3*c* and 3*d* such that the free ends of the support shafts 3*c* and 3*d* are inserted into centers of the rolls R1, R2.

Here, the rotation member 3*b* is rotatably supported by the base 2 between a state in which one of the support shafts 3*c* and 3*d* is disposed at a mounting position and a state in which the one of the support shafts 3*c* and 3*d* is disposed at a splice position. Hereinafter, the mounting position and the splice position will be described.

<Mounting Position>

In the state in which a sheet is supplied from the roll R1 supported by one (support shaft 3c in FIG. 1) of the support shafts 3c and 3d, the rotation member 3b is rotated in a state in which the other support shaft 3d is disposed at the mounting position (position shown in FIG. 1) for mounting a new roll on the other support shaft 3d.

<Splice Position>

Figure 10:
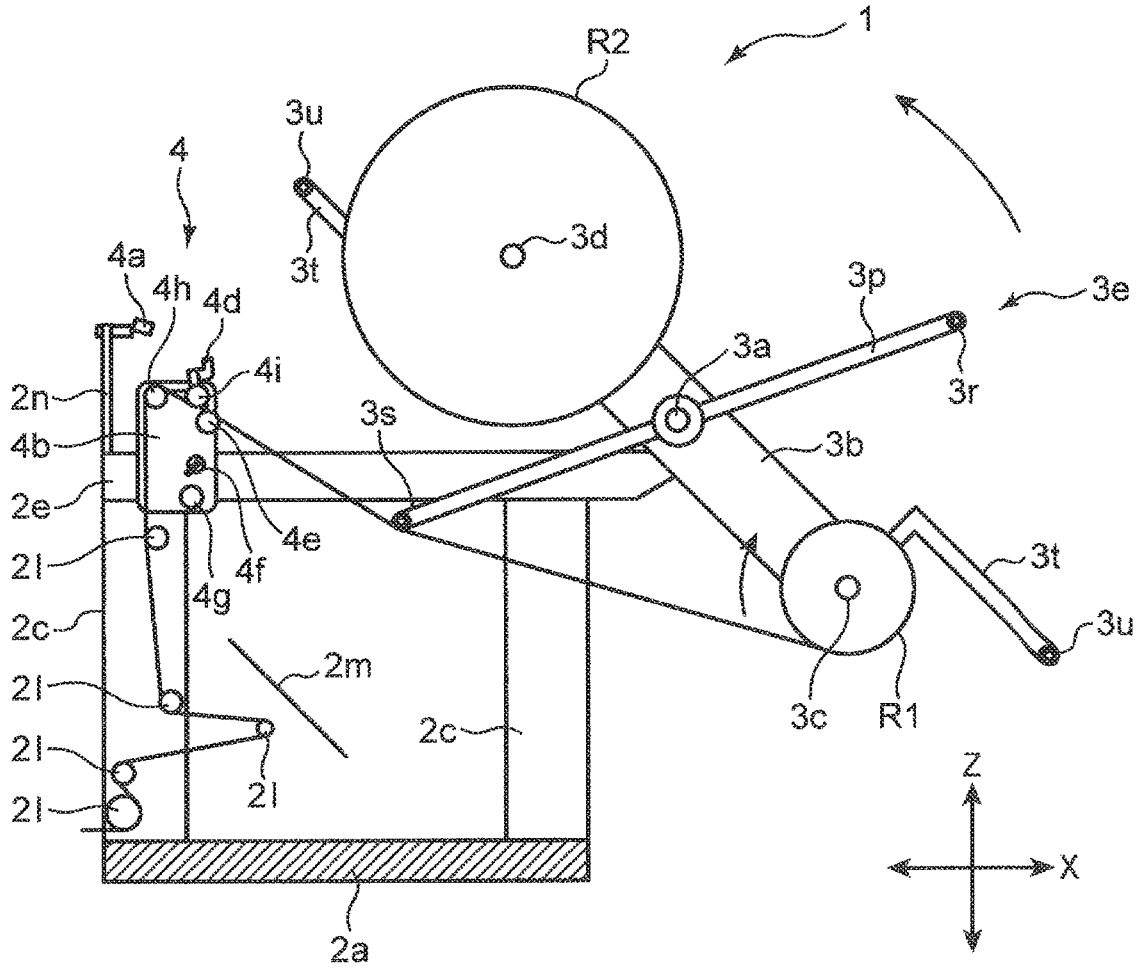
FIG. 10 is a front view showing a process in which the support shaft supporting the standby side roll in FIG. 1 is rotated toward a splice position.
Figure 11:
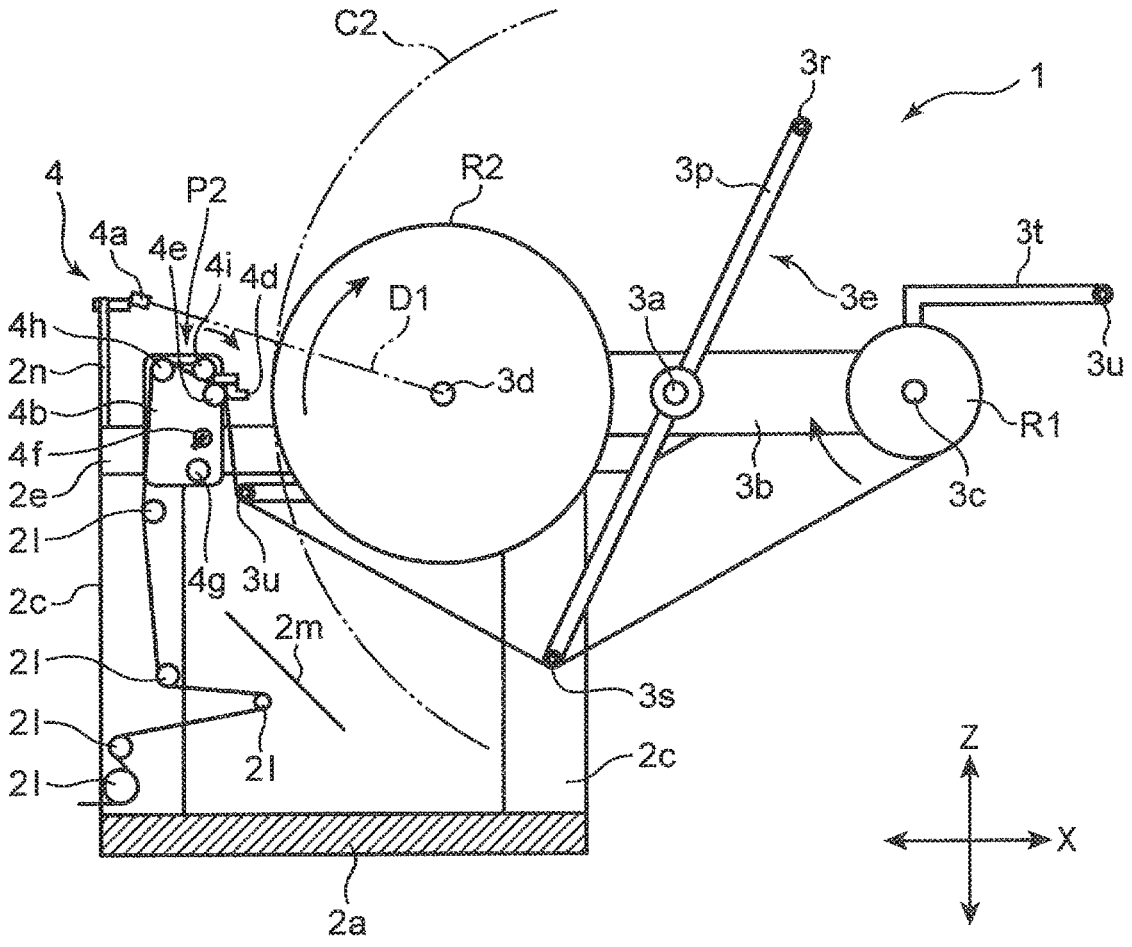
FIG. 11 is a front view showing a state in which the support shaft supporting the standby side roll shown in FIG. 1 is disposed at the splice position.

The rotation member 3b is rotated counterclockwise in FIG. 1 from the mounting position, and the rotation member 3b is rotated until the support shaft 3d is disposed at the splice position shown in FIG. 11 via the position shown in FIG. 10. In this state, a center of the rotation shaft 3a and a center of the support shaft 3d disposed at the splice position are disposed in parallel on the same horizontal plane. FIG. 2 is a plan view of the sheet supply device 1 in a state in which the support shaft 3d is disposed at the splice position.

Figure 17:
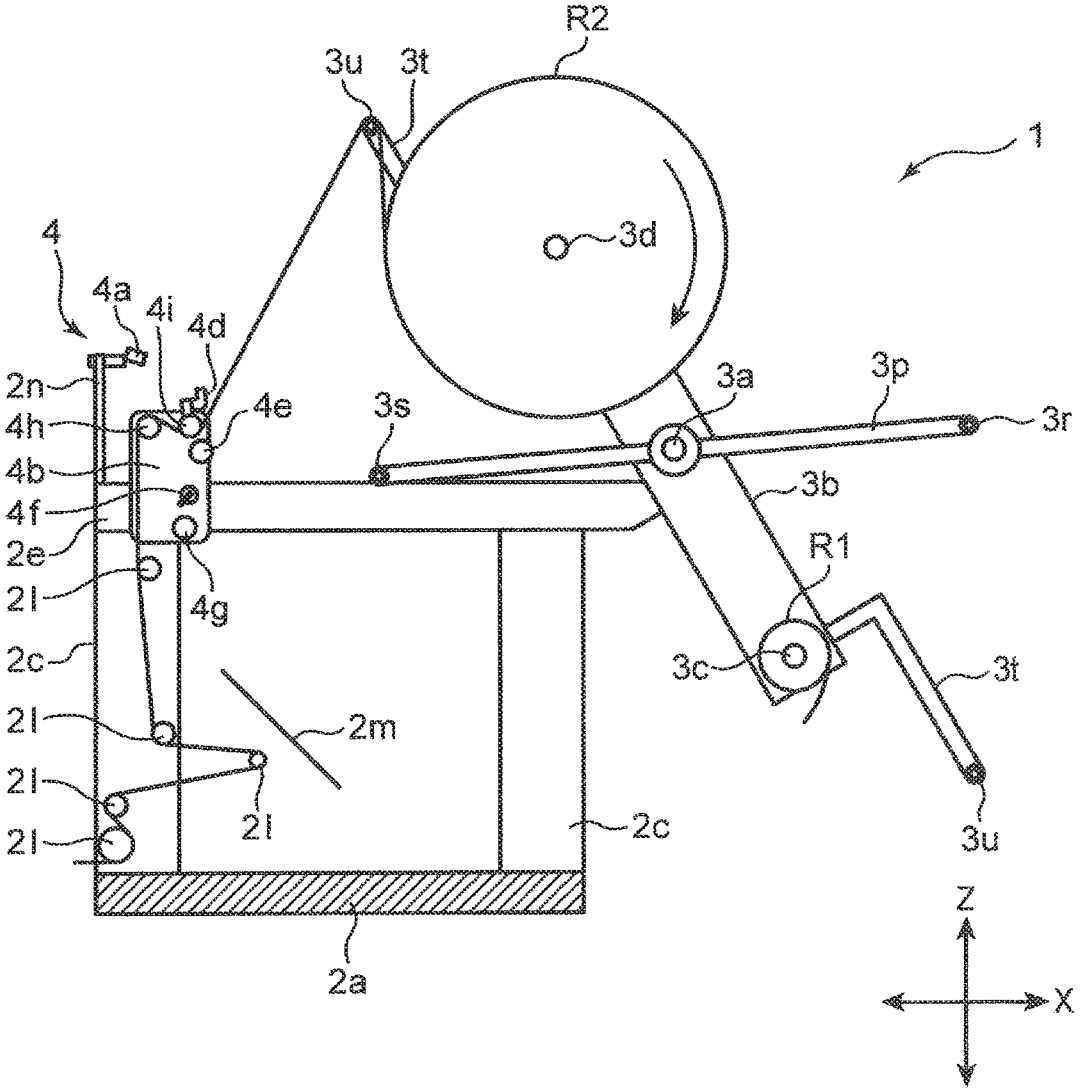
FIG. 17 is a front view showing a state in which a support shaft different from the support shaft shown in FIG. 1 is disposed at a mounting position.

At the splice position, when the sheet of the roll R1 is joined to the sheet of the roll R2 by the joining mechanism 4 described later, the supply of the sheet from the roll R2 is started, and the rotation member 3b is rotated clockwise from this state. As a result, as shown in FIG. 17, the support shaft 3c that supports the roll R1 is disposed at the above-described mounting position. As described above, the rotation member 3b is rotated forward and backward such that each of the support shafts 3c and 3d repeatedly moves from the mounting position to the splice position, and as a result, the sheets are sequentially supplied from the rolls R1 and R2 supported by the support shafts 3c and 3d.

Figure 5:
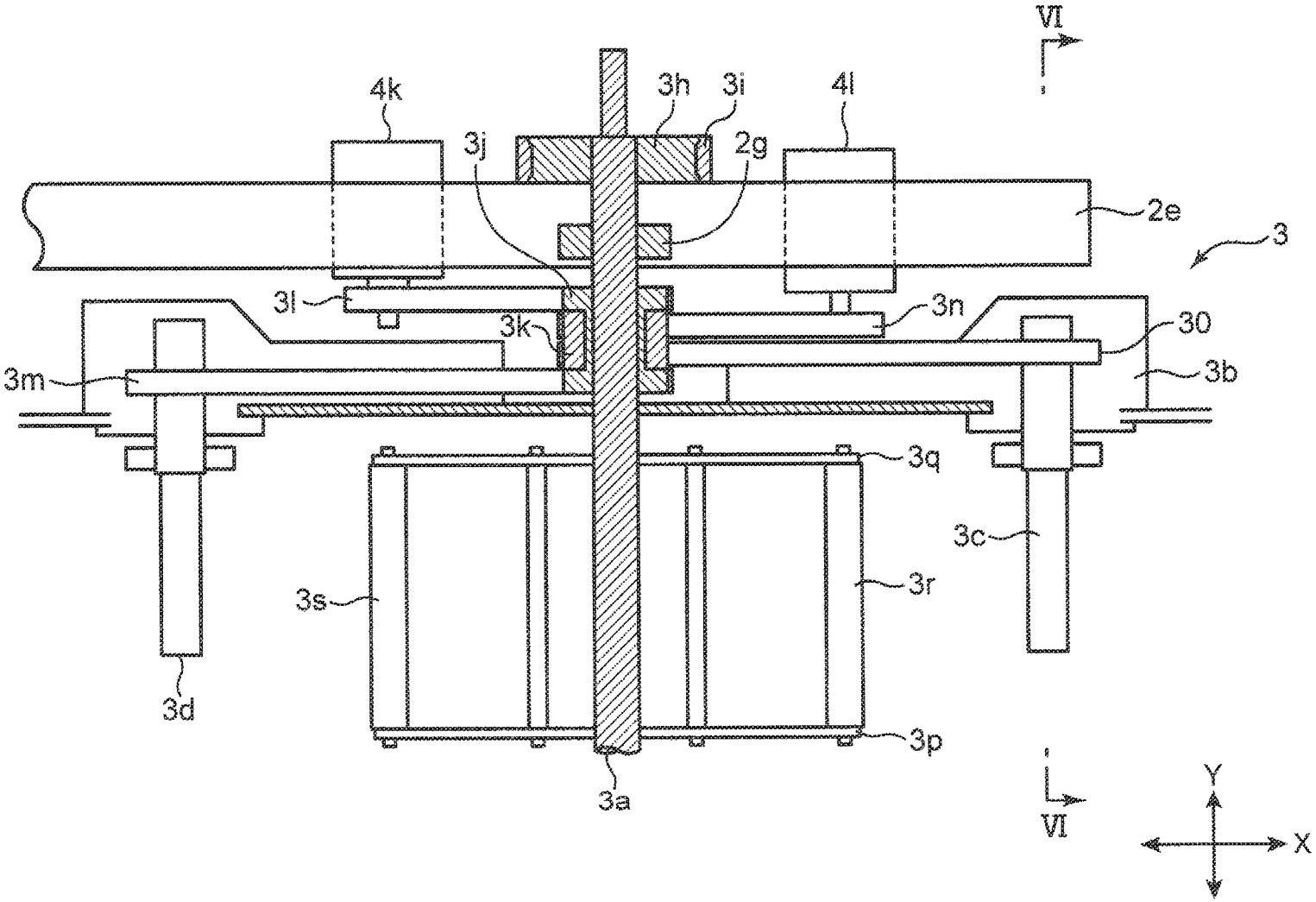
FIG. 5 is a plan cross-sectional view of a support mechanism in a state in which a support shaft supporting a standby side roll is disposed at a splice position.

Further, the support mechanism 3 includes a member drive mechanism that rotatably drives the rotation member 3b as described above, and a shaft drive mechanism that rotatably drives the support shafts 3c and 3d. Hereinafter, the member drive mechanism and the shaft drive mechanism will be described with reference to FIGS. 4 and 5. FIG. 5 is a plan cross-sectional view of the support mechanism 3 in a state in which the support shaft 3d is disposed at the splice position.

Specifically, the rotation drive mechanism includes a pulley 3h fixed to the rotation shaft 3a, and an endless belt 3i hung on the pulley 3h. The endless belt 3i is hung on a pulley fixed to a rotation shaft of a rotation member drive source (motor) 2j fixed to the column 2c of the base 2. When the rotation shaft of the rotation member drive source 2j is rotated, power of the rotation member drive source 2j is transmitted to the rotation shaft 3a via the endless belt 3i, and the rotation shaft 3a is rotated.

The shaft drive mechanism includes an inner pulley 3j that is attached to an outer side of the rotation shaft 3a in a state where the inner pulley 3j is rotatable about the rotation shaft 3a with respect to the rotation shaft 3a, an outer pulley 3k that is attached to an outer side of the pulley 3j in a state where the outer pulley 3k is rotatable about the rotation shaft 3a with respect to the pulley 3j, a first inner endless belt 3l and a second inner endless belt 3m that hang on the inner pulley 3j, and a first outer endless belt 3n and a second outer endless belt 3o that hang on the outer pulley 3k. The first inner endless belt 3l hangs on a pulley fixed to a rotation shaft of a shaft drive source (motor) 4k that is fixed to the beam 2e of the base 2, and the first outer endless belt 3n hangs on a pulley fixed to a rotation shaft of a shaft drive source (motor) 4l that is fixed to the beam 2e of the base 2. In addition, the second inner endless belt 3m hangs on a pulley fixed to the support shaft 3d, and the second outer endless belt 3o hangs on a pulley fixed to the support shaft 3c. When the rotation shafts of the shaft drive sources 4k and 4l rotate, power of the shaft drive sources 4k and 4l is transmitted to the support shafts 3c and 3d via the endless belts 3l to 3o, and the support shafts 3c and 3d rotate. In addition, since the inner pulley 3j and the outer pulley 3k are attached to the rotation shaft 3a in a state where the inner pulley 3j and the outer pulley 3k are rotatable with respect to the rotation shaft 3a, thereby the power of the shaft drive sources 4k and 4l can be transmitted to the support shafts 3c and 3d regardless of the rotating operation of the rotation shaft 3a.

Referring to FIGS. 1 to 3, the rotating guide member 3e and the adjacent guide members 3f and 3g each are for preventing a sheet of a roll (in FIG. 1, roll R1: hereinafter, the roll that is supplying the sheet is referred to as the supply side roll), which is supplying the sheet, of the rolls R1 and R2 from coming into contact with the other roll (in FIG. 1, roll R2: hereinafter, the roll other than the supply side roll are referred to as the standby side roll) when the support shafts 3c and 3d are rotated from the mounting position (see FIG. 1) to the splice position (see FIG. 11).

Specifically, the rotating guide member 3e includes a pair of holding plates 3p and 3q that are fixed to the rotation shaft 3a while extending in a direction intersecting the rotation member 3b and guide rollers 3r and 3s that are attached to both end portions of the holding plates 3p and 3q in the longitudinal direction. The holding plates 3p and 3q are fixed to the rotation shaft 3a in a state where the holding plates 3p and 3q are away from each other in the Y direction (see FIG. 2) so as to be disposed on both sides of the sheets on the rolls R1 and R2 in the Y direction. The guide rollers 3r and 3s are attached to the holding plates 3p and 3q in a state where the guide rollers 3r and 3s are rotatable about an axis along the Y direction between the holding plates 3p and 3q.

In addition, each of the adjacent guide members 3f and 3g includes a holding member 3t that extends from the rotation member 3b and a guide roller 3u that is attached to a tip of the holding member 3t. The holding member 3t is provided on one side (beam 2e side) of the rolls R1 and R2 in the Y direction. In addition, the holding member 3t has a base end portion that extends from the rotation member 3b to one side in the rotation direction (counterclockwise direction) of the rotation member 3b, and a tip portion that extends outward in the radial direction of the rotation shaft 3a from the base end portion. The guide roller 3u extends from the tip portion of the holding member 3t to a position on the other side (beam 2d side) of the rolls R1 and R2 in the Y direction, and is attached to the holding member 3t in a state where the guide roller 3u is rotatable about an axis along the Y direction.

When the rotation member 3b is rotated and the sheets of the rolls R1 and R2 come into contact with outer surfaces of the guide rollers 3r, 3s, and 3u, the sheets are guided downstream with the rotation of the guide rollers 3r, 3s, and 3u.

Figure 6:
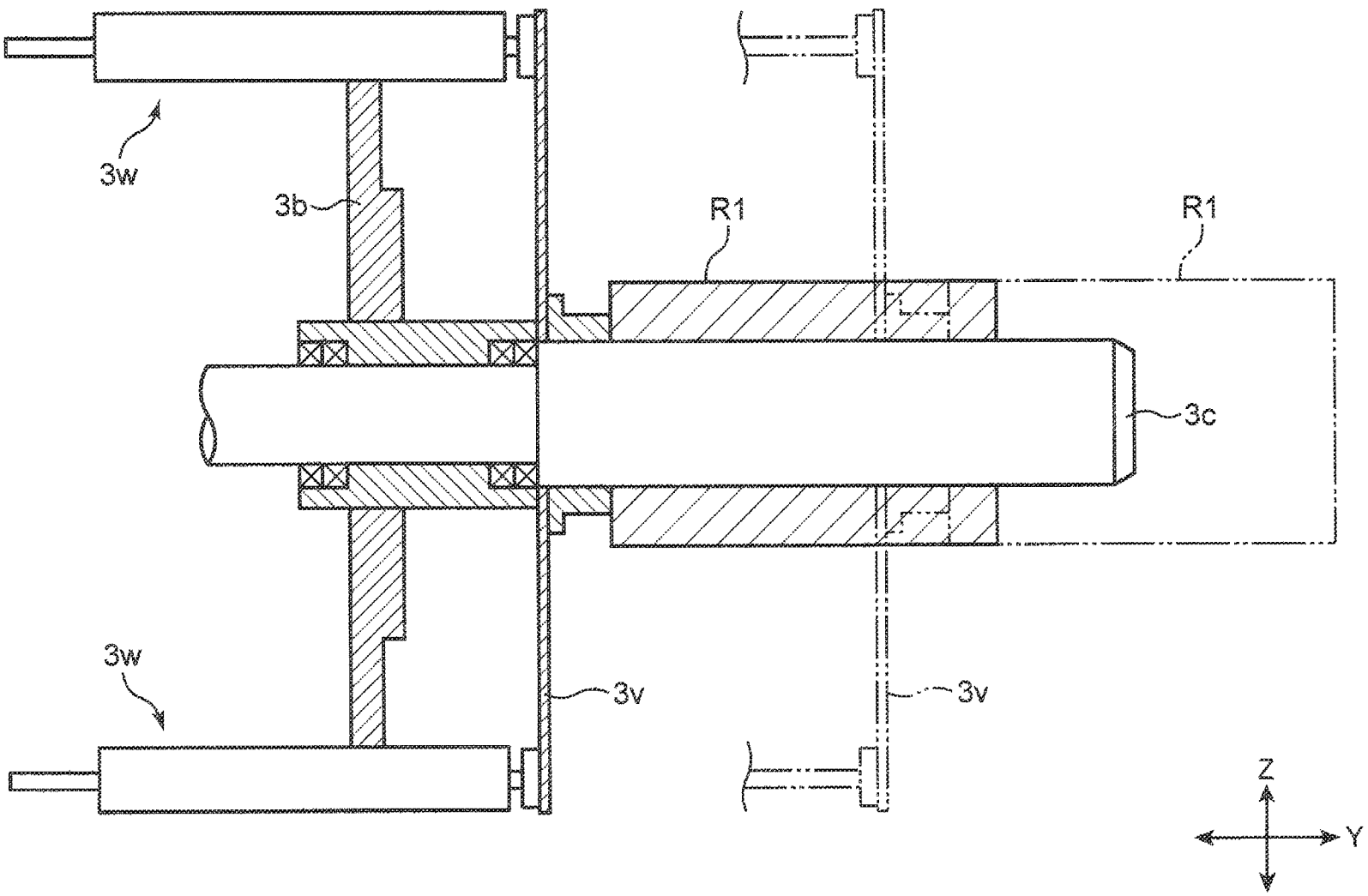
FIG. 6 is a cross-sectional view taken along line VI-VI in FIG. 5.

In addition, the support mechanism 3 includes a discharge mechanism that discharges the rolls R1, R2 mounted on the support shafts 3c, 3d from the support shafts 3c and 3d. FIG. 6 is a cross-sectional view taken along line VI-VI in FIG. 5. Although FIG. 6 shows the discharge mechanism provided on the support shaft 3c, a similar discharge mechanism is also provided on the support shaft 3d, and a description of this discharge mechanism will be omitted.

Referring to FIG. 6, the discharge mechanism includes a discharge member 3v that is attached to the support shaft 3c in a state in which the support shaft 3c penetrates, and a push-pull mechanism 3w (in the present embodiment, the number of push-pull mechanisms 3w is two, but the number of push-pull mechanisms 3*w* may be one) that pushes and pulls the discharge member 3*v* against the rotation member 3*b*. The push-pull mechanism 3*w* has a main body that is fixed to the rotation member 3*b*, and a displacement member that can be displaced in the Y direction with respect to the main body, and is constituted by, for example, an air cylinder or a motor having a ball screw mechanism. The push-pull mechanism 3*w* is configured to displace a non-discharge position where the displacement member is indicated by a solid line to a discharge position indicated by a two-dot chain line by receiving power or electric power from a discharge drive source (for example, an air supply source or a power supply: see FIG. 18) 2*k* provided on the base 2. The discharge member 3*v* moves in the Y direction as indicated by the two-dot chain line due to the displacement of the displacement member, and the roll R1 is pressed and discharged from the support shaft 3*c*.

Referring to FIGS. 1 and 2, the joining mechanism 4 includes an outer diameter detector 4*a* that is fixed to the base 2, a moving unit (a part of the pressing mechanism) 4*b* that is attached to the base 2 so as to be movable in the X direction with respect to the base 2, a unit drive mechanism 4*c* (see FIG. 4) that drives the moving unit 4*b*, an adhesion member detector 4*d*, a pressing roller (a part of the pressing mechanism) 4*e*, a cutter 4*f*, a first guide roller 4*g* (another guide roller), a second guide roller 4*h* (guide roller), a third guide roller 4*i*, and an urging mechanism (see FIG. 8) 4*j* that are attached to moving unit 4*b*, and the above-described shaft drive sources 4*k* and 4*l* (see FIG. 5).

The outer diameter detector 4*a* detects the outer diameter of the standby side roll (roll R2 in FIG. 11) disposed at the splice position, and is constituted by, for example, a laser sensor. The outer diameter detector 4*a* is fixed on the moving unit 4*b* by a bracket 2*n* that is provided at a position opposite to the support mechanism 3 with respect to the moving unit 4*b* in the two beams 2*d* and 2*e* so as to extend across the two beams 2*d* and 2*e* of the base 2. In addition, a detection axis D1 (see the two-dot chained line in FIG. 11: trajectory through which a center of a detection range passes from the outer diameter detector 4*a* to the roll: optical axis in the case of the laser sensor) of the outer diameter detector 4*a* attached to the bracket 2*n* is disposed at the same position in the Y direction as a central line of the standby side roll (roll R2 in the case of FIG. 11) in a width direction (Y direction), and is disposed perpendicularly to a central axis (central axis of the support shaft) of the standby side roll (see FIG. 11).

Figure 7:
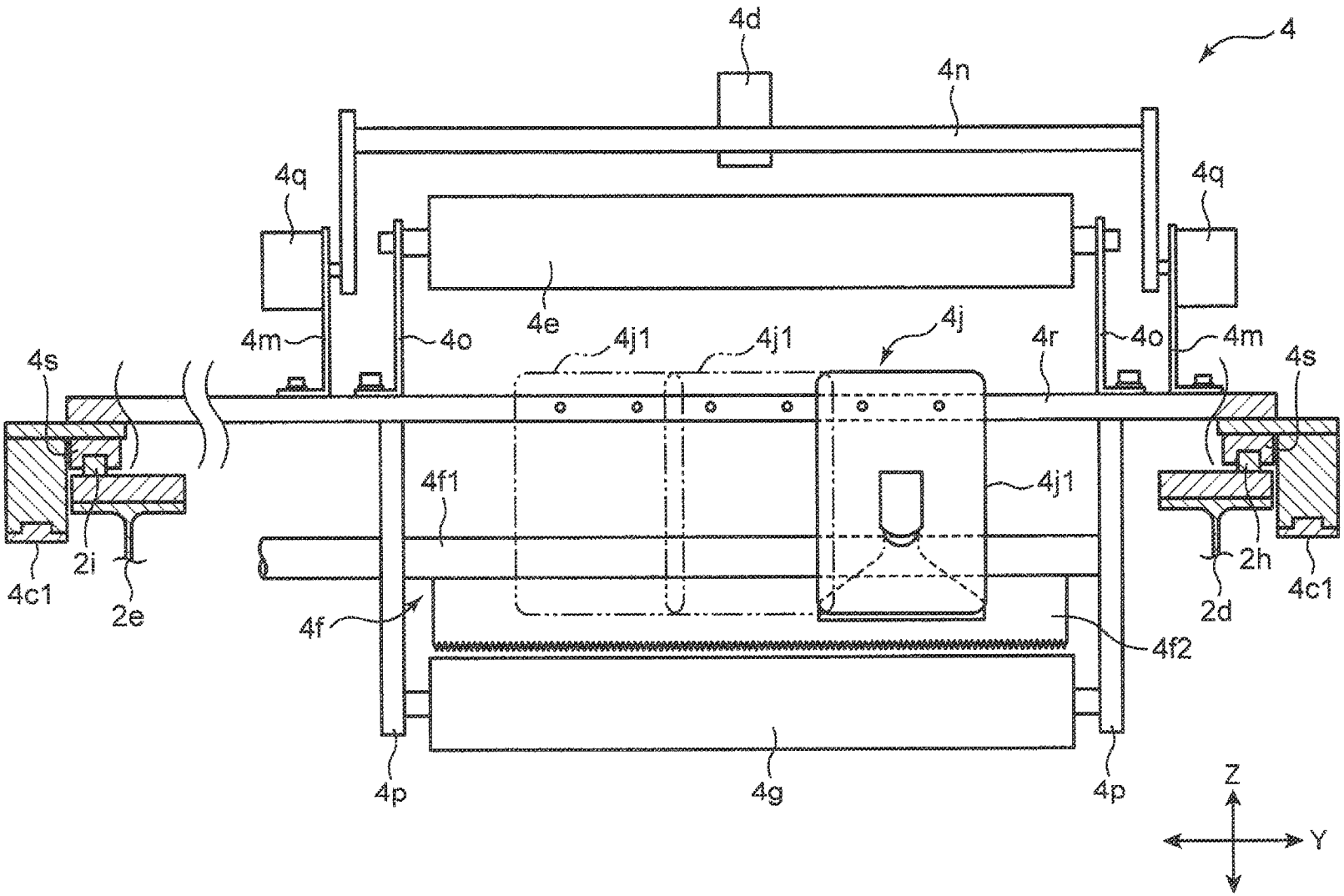
FIG. 7 is a partial side cross-sectional view showing a moving unit a part of which is omitted.

FIG. 7 is a partial side cross-sectional view showing the moving unit 4*b* a part of which is omitted. In FIG. 7, the second guide roller 4*h* and the third guide roller 4*i* are omitted.

The moving unit 4*b* includes a moving plate 4*r* that is provided on the two beams 2*d* and 2*e* of the base 2, a pair of sliders 4*s* that is fixed to both end portions of the moving plate 4*r* in the Y direction, a pair of detector brackets 4*m* that stands on the moving plate 4*r* so as to face each other in the Y direction, a revolution member 4*n* that is provided so as to extend across the two detector brackets 4*m*, a pair of roller support members 4*o* that stands on the moving plate 4*r* so as to face each other in the Y direction between the two detector brackets 4*m*, and a pair of brackets 4*p* that extends downward from a lower surface of the moving plate 4*r* so as to face each other in the Y direction.

The pair of sliders 4*s* is engaged with the rails 2*h* and 2*i* of the beams 2*d* and 2*e*, respectively. Thereby, the moving plate 4*r*, that is, the moving unit 4*b* can move in the X direction along the rails 2*h* and 2*i* with respect to the base 2. As shown in FIGS. 1 and 3, the portions (mounting plates 2*a*, columns 2*b* and 2*c*, beams 2*d* and 2*e*, rails 2*h* and 2*i*) that extend from the shaft support parts 2*f* and 2*g* to the moving unit 4*b* side in the base 2 correspond to a unit support part which has the moving unit 4*b* movably attached thereto and is mounted on a preset mounting surface. As shown in FIG. 1, the support shaft (support shaft 3*d* in FIG. 1) disposed at the mounting position is disposed in an area other than the area overlapping with the shaft support parts 2*f* and 2*g* and the unit support part in a side view viewed along the rotation shaft 3*a*.

Referring to FIGS. 4 and 7, the unit drive mechanism 4*c* that drives the moving plate 4*r* in the X direction are provided on each of the beam 2*d* and beam 2*e* of the base 2. Since these unit drive mechanisms 4*c* have the same configuration, only the unit drive mechanism 4*c* provided on the beam 2*e* will be described below. The unit drive mechanism 4*c* includes an endless belt 4*c*1 that is fixed to the moving plate 4*r*, a plurality of pulleys 4*c*2 that are provided on the beam 2*e* of the base 2 and has the endless belt 4*c*1 hanging thereon, and a unit drive source (servomotor, detector drive source, a part of the pressing member) 4*c*3 that is provided on the column 2*c* of the base 2. The unit drive source 4*c*3 has a rotation shaft (no reference numeral) on which the endless belt 4*c*1 hangs via the pulley. The plurality of pulleys 4*c*2 circularly hold the endless belt 4*c*1 such that a part of the endless belt 4*c*1 extends along the X direction, and the moving plate 4*r* is fixed to a part of the endless belt 4*c*1 extending in the X direction. When the unit drive source 4*c*3 is rotated in one direction, the power of the unit drive source 4*c*3 is transmitted via the endless belt 4*c*1, and the moving plate 4*r* advances toward the support mechanism 3, while when the unit drive source 4*c*3 is rotated in a reverse direction, the moving plate 4*r* retracts in a direction away from the support mechanism 3. As described above, the moving plate 4*r* advances and retracts in the X direction by the unit drive mechanism 4*c*.

The pair of roller support members 4*o* provided on the moving plate 4*r* are attached with the pressing roller 4*e* that presses the sheet of the supply side roll (roll R1 in FIG. 11) against the outer peripheral surface of the standby side roll (roll R2 in FIG. 11) in response to the driving of the unit drive mechanism 4*c*. The pressing roller 4*e* is disposed between the two roller support members 4*o*, and is rotatably attached to the two roller support members 4*o* about the axis along the Y direction.

In addition, in a state in which one (roll R2 in FIG. 14) of the rolls R1 and R2 is disposed at the splice position, the rotation shaft 3*a*, the support shaft 3*d*, and the pressing roller 4*e* are attached to the base such that the center of the rotation shaft 3*a*, the center of the support shaft 3*d*, and the center of the pressing roller 4*e* are disposed in parallel with each other on the same horizontal plane. In this state, the unit drive mechanism 4*c* moves (advances) the moving unit 4*b* in the horizontal direction, and as a result, the pressing roller 4*e* moves in the radial direction of the roll R2 such that the center of the pressing roller 4*e* moves on a straight line passing through the center of the rotation shaft 3*a* and the center of the support shaft (support shaft 3*d* in FIG. 11) disposed at the splice position, and the pressing roller 4*e* is pressed against the roll R2. As described above, the pressing roller 4*e* is pressed against a position (hereinafter, referred to as a pressing position P1) intersecting a straight line connecting between the center of the rotation shaft 3*a*, the center of the support shaft 3*d*, and the center of the pressing roller 4*e* on the outer peripheral surface of the roll (roll R2 in FIG. 14) that is disposed at the splice position by the unit drive mechanism 4*c*.

The moving unit 4*b* supports the pressing roller 4*e* (is attached to the base 2) such that the pressing roller 4*e* can be approached to and detached from the outer peripheral surface of the roll between an advance position (an example of a proximity position: see FIG. 14) where the pressing roller 4*e* is pressed against the pressing position P1 and a retracted position (see FIGS. 1 and 10) where the pressing roller 4*e* is away from the pressing position P1. When the support shaft is disposed at the splice position (see FIG. 11) in the state in which the assumed roll having the largest outer diameter is supported by the support shaft, the retracted position is a preset position as a position where the moving unit 4*b* and parts provided on the moving unit 4*b* can avoid the contact with the roll.

Referring to FIGS. 4 and 7, the revolution member 4*n* provided on the moving unit 4*b* is attached to the pair of detector brackets 4*m* in the state where the revolution member 4*n* is rotatable about the rotation shaft extending in the Y direction with respect to the pair of detector brackets 4*m*. In addition, the moving unit 4*b* is provided on the pair of detector brackets 4*m*, and includes a revolution drive source (for example, a motor) 4*q* that applies power for rotating the revolution member 4*n* to the revolution member 4*n*.

The revolution member 4*n* is attached with the adhesion member detector 4*d* that is constituted by, for example, a color sensor (for example, a line sensor or an area sensor) that can detect the position of an adhesion member H (see FIG. 12) in a rotation direction of a standby side roll, the adhesion member H being provided on the outer peripheral surface of the standby side roll. Here, the adhesion member H is a member (for example, double-sided tape) that is provided on the outer peripheral surface of the standby side roll, fastens an end of the sheet on the outer peripheral surface of the standby side roll, and permits adhesion from the outer side of the sheet of the supply side roll.

The adhesion member detector 4*d* is attached to the revolution member 4*n* such that a detection axis of the adhesion member detector 4*d* is disposed at the same position in the Y direction as the central line of the sheet of the standby side roll (R2 in FIG. 11) at the splice position (see FIG. 11) in the width direction (Y direction). The detection axis is a trajectory through which a midpoint of a detection line from the line sensor to an object to be detected passes, in the case of the line sensor, and a trajectory through which a center of an imaging range from the area sensor to the object to be detected passes, in the case of the area sensor.

Figure 12:
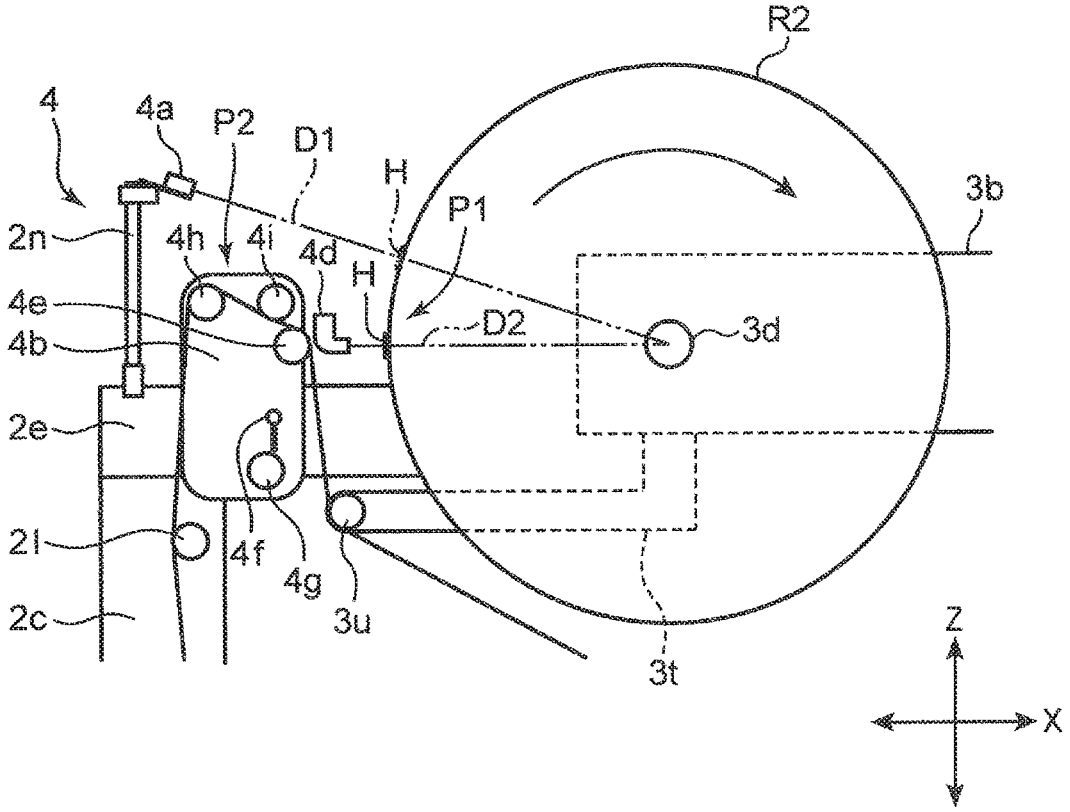
FIG. 12 is a partially enlarged front view showing a state in which the moving unit is disposed at a position corresponding to a detectable position.
Figure 13:
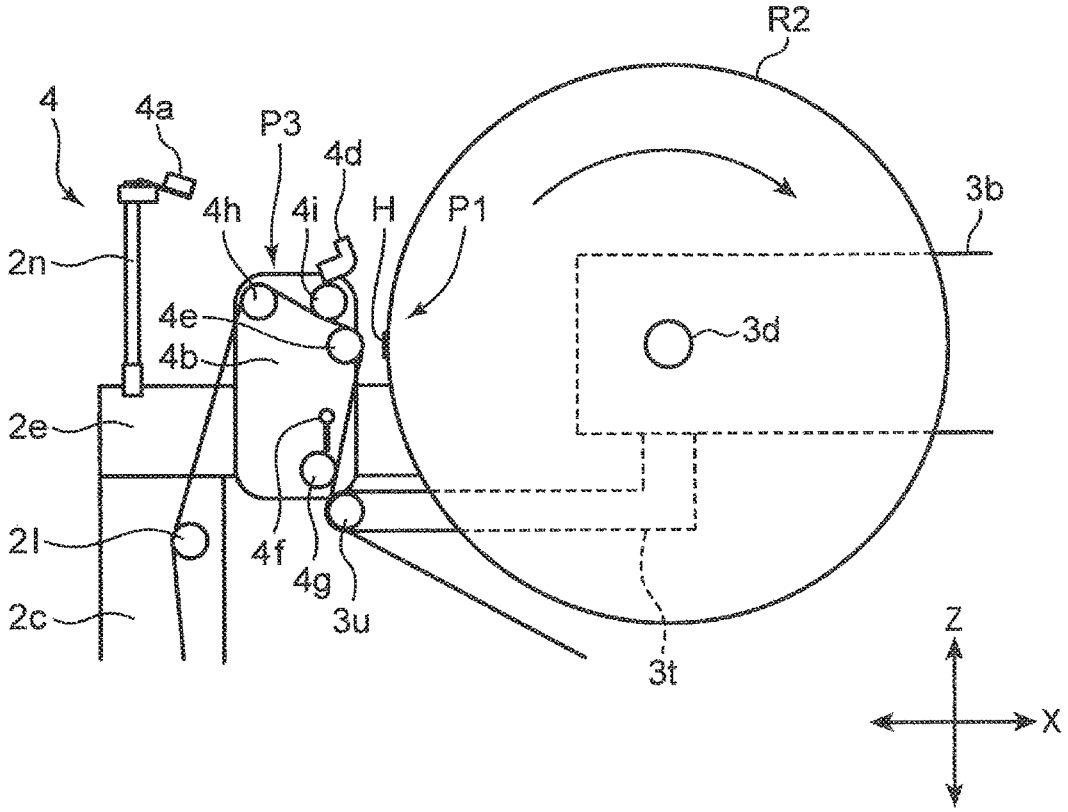
FIG. 13 is a partially enlarged front view showing a state in which the moving unit is disposed at a control switching position.

Further, the revolution member 4*n* can revolve with respect to a roller support member 4*o* between a detected position where the adhesion member detector 4*d* is disposed between the pressing roller 4*e* and the support shaft 3*d* such that a detection axis D2 of the adhesion member detector 4*d* is disposed perpendicularly with respect to the center of the support shaft 3*d*, as shown in FIG. 12, and a retracted position where the adhesion member detector 4*d* retracts from a position between the pressing roller 4*e* and the support shaft 3*d*, as shown in FIG. 13. The retracted position is the position of the adhesion member detector 4*d* set such that the distance from the adhesion member detector 4*d* to the center of the support shaft 3*d* is longer than the distance from the pressing roller 4*e* to the center of the support shaft 3*d*. The detection axis D2 of the adhesion member detector 4*d* disposed at the detected position is disposed at the same position as a straight line (see FIG. 14) connecting between the center of the rotation shaft 3*a*, the center of the support shaft 3*d*, and the center of the pressing roller 4*e* in a front view.

Figure 8:
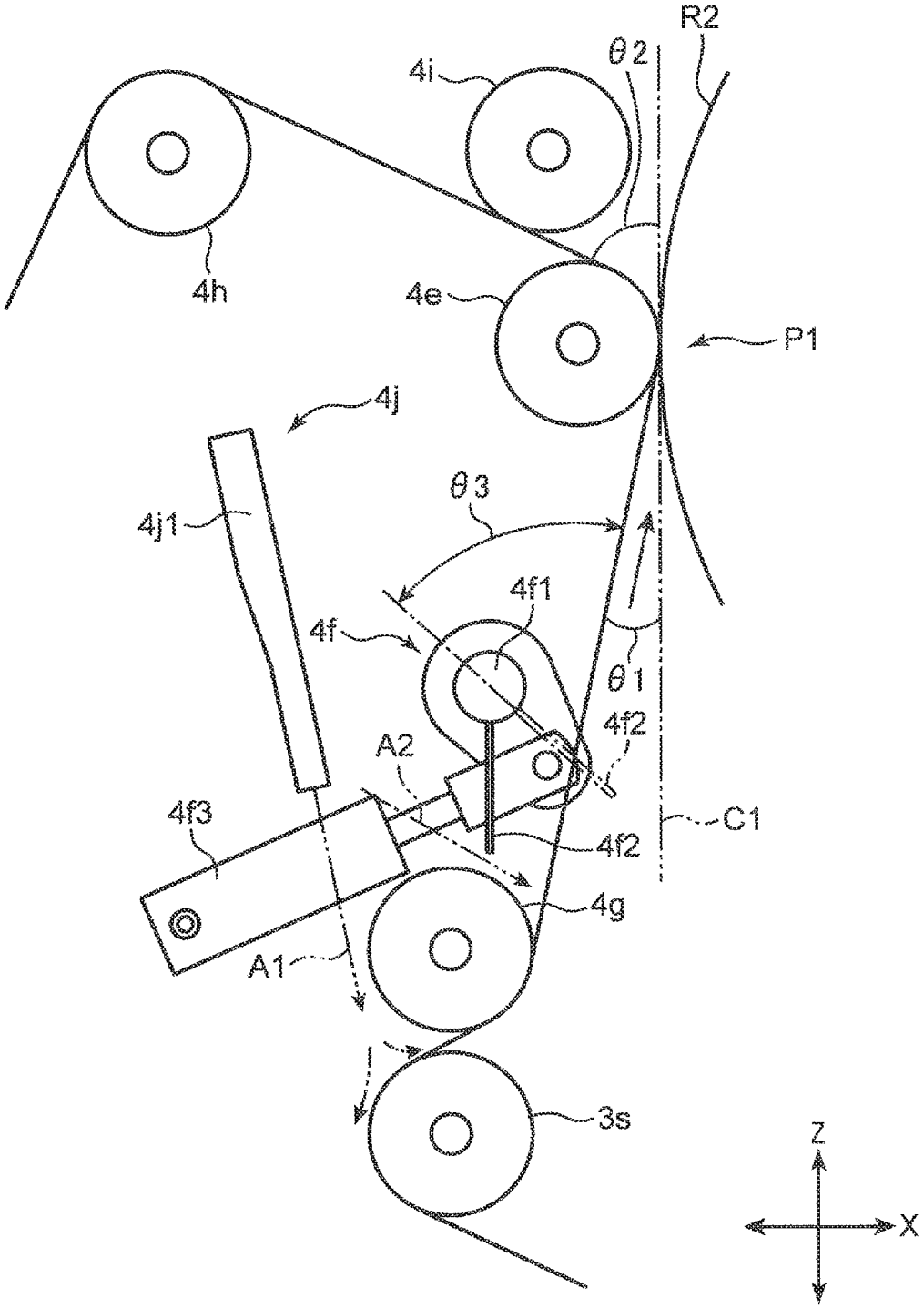
FIG. 8 is a schematic front view of a joining mechanism showing a positional relationship among a pressing roller, a cutter, a first guide roller, a second guide roller, a third guide roller, and an urging mechanism.

FIG. 8 is a schematic front view of the joining mechanism 4 showing the positional relationship among the pressing roller 4*e*, the cutter 4*f*, the first guide roller 4*g*, the second guide roller 4*h*, the third guide roller 4*i*, and the urging mechanism 4*j*. FIG. 8 shows a state in which the moving unit 4*b* moves to the advance position and the pressing roller 4*e* is pressed against the roll R2.

Referring to FIGS. 7 and 8, the pair of brackets 4*p* is attached with the first guide roller 4*g* that guides the sheet drawn from the supply side roll toward the pressing position P1 of the standby side roll (roll R2 in FIG. 8) disposed at the splice position. The first guide roller 4*g* is disposed between the two brackets 4*p*, and is rotatably supported by the two brackets 4*p* about an axis along the Y direction. Further, the first guide roller 4*g* is disposed at a position farther in the X direction from the roll (roll R2 in FIG. 8) disposed at the splice position than the pressing roller 4*e*, and is disposed below the pressing roller 4*e*. Thereby, as shown in FIG. 8, when the pressing roller 4*e* is pressed against the roll, the first guide roller 4*g* presses a middle part of a sheet guided from the guide roller 3*s* of the support mechanism 3 to the pressing position against the roll R2 side (support mechanism 3 side). As a result, the sheet is guided from the first guide roller 4*g* to the pressing position P1 at an angle θ1 with respect to a tangential line C1 to the outer peripheral surface of the roll at the pressing position P1.

In addition, the second guide roller 4*h* and the third guide roller 4*i* are attached to the roller support member 4*o* shown in FIG. 7. The two guide rollers 4*h* and 4*i* are each disposed between the two roller support members 4*o*, and are rotatably supported to the two roller support members 4*o* about the axis along the Y direction.

The second guide roller 4*h* is disposed at a position farther in the X direction from the roll (roll R2 in FIG. 8) disposed at the splice position than the pressing roller 4*e*, and is disposed above the pressing roller 4*e*. Thereby, as shown in FIG. 8, the second guide roller 4*h* changes a direction of a sheet downward at the second guide roller 4*h* to guide the sheet downward, the sheet being guided obliquely upward from the pressing position P1 to the second guide roller 4*h* in the state in which the pressing roller 4*e* is pressed against the roll. Here, the sheet is guided from the pressing position P1 to the second guide roller 4*h* at an angle θ2 with respect to the tangential line C1 to the outer peripheral surface of the roll at the pressing position P1.

Hereinafter, the disposition and functions of the first guide roller 4*g* and the second guide roller 4*h* will be described.

The second guide roller 4*h* is disposed on an opposite side to the roll (roll R2 in FIG. 8) at the splice position based on the tangential line C1 in the state where the pressing roller 4*e* is pressed against the pressing position P1. In addition, the second guide roller 4*h* guides the sheet such that the sheet is guided from the pressing roller 4*e* in a direction away from the roll R2.

The first guide roller 4*g* is disposed on the opposite side to the roll (roll R2 in FIG. 8) at the splice position based on the tangential line C1, and on the opposite side to the second guide roller 4*h* based on a plane including the pressing position P1 and the center of the pressing roller 4*e* in the state in which the pressing roller 4*e* is pressed against the pressing position P1. In addition, the first guide roller 4*g* guides the sheet such that the sheet is guided from the first guide roller 4*g* to the pressing position P1 in a direction approaching the roll R2.

The angle θ2 between the sheet guided from the pressing position P1 to the second guide roller 4*h* and the tangential line C1 is greater than the angle θ1 between the sheet guided from the first guide roller 4*g* to the pressing position P1 and the tangential line. As described above, since the angle θ1 is set to be smaller than the angle θ2, a space for the cutter 4*f* can be secured on an opposite side of the standby side roll R2 with respect to the sheet. In addition, since the angle θ1 is set to be smaller than the angle θ2, the guide roller 3*s* that guides the sheet to the pressing position P1 can be disposed close to the tangential line C1, and the sheet supply device 1 can be configured compactly.

The third guide roller 4*i* is disposed at a position closer to the tangential line C1 than the second guide roller 4*h* is, on an opposite side (upper side) of the first guide roller 4*g* with respect to the pressing roller 4*e*. As shown in FIG. 1, when one support shaft (support shaft 3*d* in FIG. 1) is disposed at the mounting position, the third guide roller 4*i* is provided to apply tension to the sheet between the support shaft and one guide roller 3*u*.

In addition, the cutter 4*f* configured to be capable of cutting a sheet between the first guide roller 4*g* and the pressing roller 4*e* is attached to the pair of brackets 4*p*. The cutter 4*f* includes a shaft 4*f*1 that is rotatably attached to both brackets 4*p* about a shaft extending in the Y direction, a rotary blade 4*f*2 that extends in the Y direction along the shaft 4*f*1 and is fixed to the shaft 4*f*1, cutter driving means 4*f*3 that rotatably drives the rotary blade 4*f*2 about the rotation shaft 4*f*1, and a cutter drive source 4*f*4 (see FIG. 18) that supplies air to the cutter driving means 4*f*3. The cutter driving means 4*f*3 is constituted by an air cylinder that has a cylinder and a rod that can be extended and retracted with respect to the cylinder. In addition, the cutter drive source 4*f*4 is constituted by a compressor or the like that supplies compressed air to the cutter driving means 4*f*3. The cutter driving means 4*f*3 may be constituted by a motor having a ball screw mechanism. In this case, the cutter drive source 4*f*4 may be constituted by a power supply that supplies electric power to the motor.

The cutter 4*f* is provided at a position (position opposite to the roll based on the tangential line C1) away from the sheet in the X direction between the first guide roller 4*g* and the pressing roller 4*e* (that is, below the pressing roller 4*e*). The cutter 4*f* is attached to the moving unit 4*b* in a state where the cutter 4*f* is moveable (rotatable) between a non-cutting position (position indicated by a solid line in FIG. 8) away from the sheet and a cutting position (position indicated by a two-dot chain line in FIG. 8) for cutting the sheet. Specifically, the rotary blade 4*f*2 rotated to the non-cutting position is disposed at a position away from the sheet between the first guide roller 4*g* and the pressing roller 4*e* in the X direction, and a tip portion of the rotary blade 4*f*2 rotated to the cutting position is disposed so as to intersect the sheet between the first guide roller 4*g* and the pressing roller 4*e*. In addition, the rotary blade 4*f*2 rotated to the cutting position takes a posture inclined downward with respect to a direction orthogonal to the sheet between the first guide roller 4*g* and the pressing roller 4*e*. Specifically, in the present embodiment, when an angle θ3 between the rotary blade 4*f*2 and the sheet is about 38°, the tip portion of the rotary blade 4*f*2 comes into contact with the sheet, but when the rotary blade 4*f*2 is further rotated from the contact position toward the sheet by about 5° to about 15°, the sheet is easily cut. Specifically, when the angle θ3 rotates from the contact position by about 10°, the sheet is most easily cut. As described above, the cutter 4*f* cuts the sheet of the supply side roll R1 at a position below the center (the center of the support shaft 3*d*) of the standby side roll R2.

Figure 9:
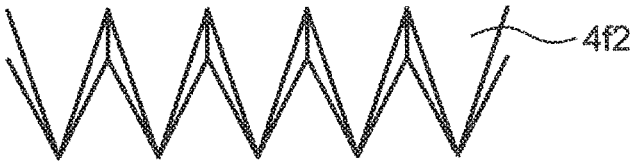
FIG. 9 is a schematic view showing a blade edge shape of a rotary blade.

FIG. 9 is a schematic view showing the blade edge shape of the rotary blade 4*f*2. As shown in FIG. 9, the rotary blade 4*f*2 has a plurality of V-shaped blades arranged in the Y direction, and these blades pierce the sheet to cut the sheet.

Figure 18:
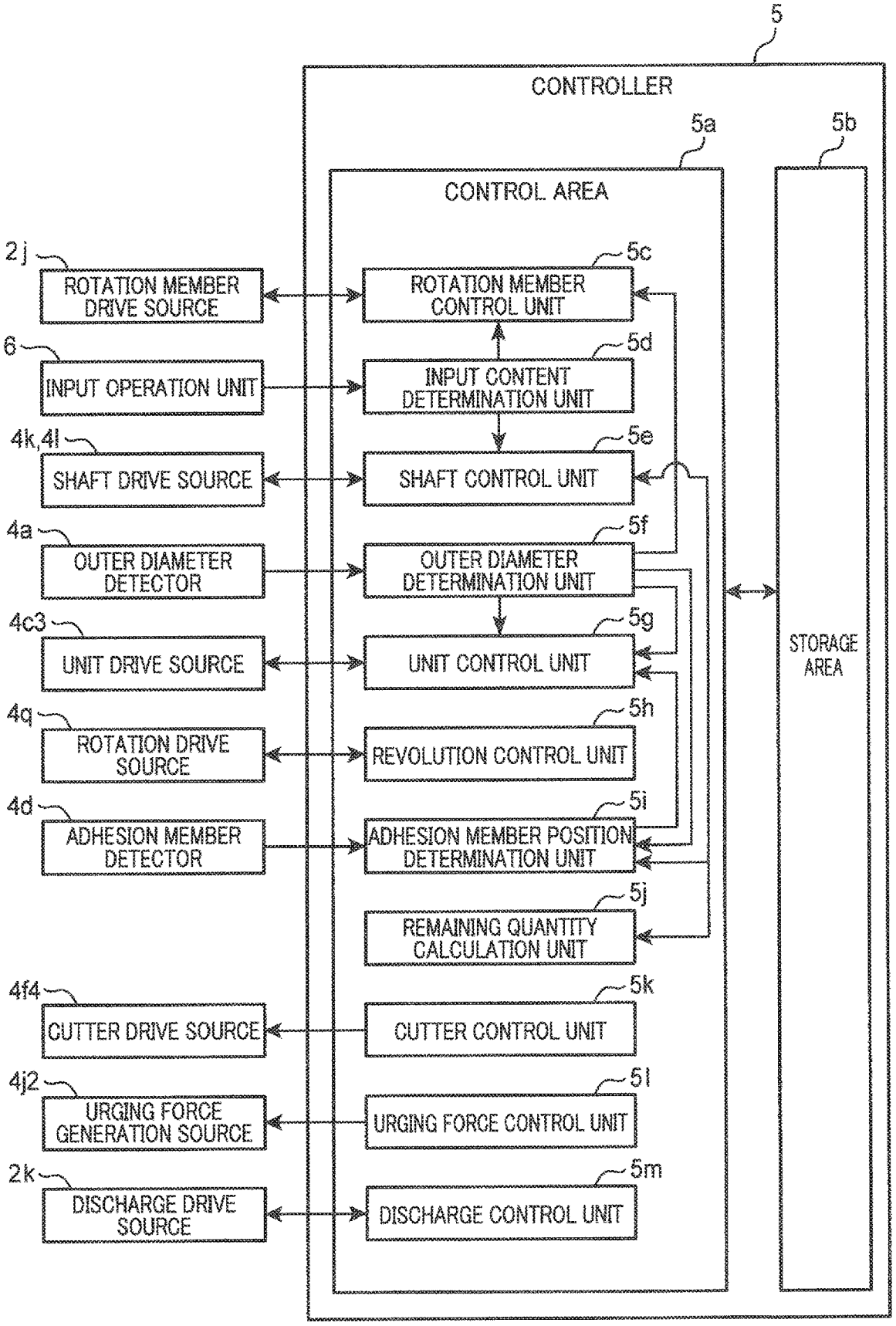
FIG. 18 is a block diagram showing an electrical configuration of a controller.

Referring to FIGS. 7, 8, and 18, the urging mechanism 4*j* is configured to be switched between a supply state in which a force in a direction away from the pressing position P1 is applied to a portion (hereinafter, referred to as a remaining portion) on an upstream side of the sheet in the conveyance direction from the cutting position by the cutter in the sheet of the roll (for example, roll R2 in FIG. 8) disposed at the splice position and a stop state in which the application of the force stops.

Specifically, the urging mechanism 4*j* includes an air nozzle 4*j*1 and an urging force generation source 4*j*2 (see FIG. 18) that supplies compressed air to the air nozzle 4*j*1.

The air nozzle 4*j*1 has an outlet that blows out the compressed air supplied from the urging force generation source 4*j*2. The outlet of the air nozzle 4*j*1 is disposed downward toward the guide roller 3*s* of the support mechanism 3 so as to apply a force to the upstream side of the sheet in the conveyance direction based on the first guide roller 4*g* in the sheet in the state in which the pressing roller 4*e* is pressed against the roll. In addition, the air nozzle 4*j*1 is detachably attached to the moving plate 4*r* of the moving unit 4*b* by a bolt (not shown). Specifically, the air nozzle 4*j*1 is attached to the moving plate 4*r* in the state in which a center position of the outlet of the air nozzle 4*j*1 in the Y direction coincides with a center position of the roller disposed at the splice position in the width direction (Y direction). There are a plurality of types of rolls R1 and R2 having different width dimensions, and a plurality of screw holes (see FIG. 7: no reference numeral) are provided on the moving plate 4*r* such that the mounting position of the air nozzle 4*j*1 can be changed for each of the plurality of types of rolls R1 and R2. For example, the air nozzle 4*j*1 can be attached to the moving plate 4*r* at a position indicated by a solid line and two positions indicated by a two-dot chain line in FIG. 7.

The compressed air blowing out from the outlet of the air nozzle 4*j*1 attached in this way is blown to the guide roller 3*s* through a position opposite to the cutter 4*f* of the first guide roller 4*g* as indicated by an arrow A1 in FIG. 8. As a result, a flow of air passing through the side of the guide roller 3*s* and a flow of air passing between the guide roller 3*s* and the first guide roller 4*g* are formed, and a force in a direction (downward in the present embodiment) away from the pressing position P1 is applied to the remaining portion of the sheet by these flows of air. In addition, the distance from the portion of the sheet where the force is applied from the air nozzle 4*j*1 to the first guide roller 4*g* is smaller than the distance from the first guide roller 4*g* to the cutting position by the cutter 4*f*.

Here, the first guide roller 4*g* is disposed below the pressing roller 4*e* such that the downstream portion of the first guide roller 4*g* is bent upward with respect to the upstream portion of the first guide roller 4*g* in the conveyance direction in a conveyance path of the sheet. In this state, since the urging mechanism 4*j* applies a downward force to the sheet, it can more reliably urge the remaining portion of the sheet in the direction away from the pressing position by utilizing the effect of gravity.

As indicated by an arrow A2 in FIG. 8, the outlet of the air nozzle 4*j*1 can be disposed such that the compressed air blows downward to the downstream side of the sheet in the conveyance direction from the first guide roller 4*g* in the sheet, specifically, the portion between the first guide roller and the cutter 4*f*'Even in this case, the force in the direction away from the pressing position P1 is applied to the remaining portion of the sheet.

Hereinafter, the sheet supply operation by the sheet supply device 1 will be described. In the following description, it is assumed that the operation is started from the state in which the sheet of the roll R1 supported by the support shaft 3*c* is supplied.

As shown in FIG. 1, in the state in which the rotation member 3*b* is rotated such that the support shaft 3*d* is disposed at the mounting position, the sheet is conveyed from the roll R1 supported by the support shaft 3*c* in the direction away from the rotation shaft 3*a*. Specifically, the sheet of the roll R1 is guided upward toward the guide roller 3*u* adjacent to the support shaft 3*d*, the conveyance direction of the sheet is changed downward by the guide roller 3*u*, changed upward by the third guide roller 4*i* of the moving unit 4*b*, and furthermore changed downward by the second guide roller 4*h*. The sheet guided to the second guide roller 4*h* is conveyed to the downstream side via a plurality of rollers 2*l* provided below the moving unit 4*b* in the base 2. A roller 2*l* shown at the bottom of FIG. 1 in the plurality of rollers 2*l* is driven by a motor (not shown), and one disposed above the roller 2*l* is a tension control roller. That is, a tension control roller 2*l* is provided between the moving unit 4*b* and a driving roller 2*l*.

In addition, in the state shown in FIG. 1, the standby side roll (roll R2 in the figure) around which the sheet to be subsequently conveyed is wound is mounted on the support shaft 3*d* disposed at the mounting position.

After the standby side roll is mounted, a worker performs a predetermined operation, and as a result, the rotation member 3*b* is rotated counterclockwise, and the support shaft (support shaft 3*d* in the figure) supporting the standby side roll is disposed at the splice position shown in FIG. 11 via the posture shown in FIG. 10. In this state, the sheet of the supply side roll (roll R1 in the figure) is guided downward from the supply side roll by the guide roller 3*s* disposed below both support shafts 3*c* and 3*d*, the conveyance direction of the sheet is changed upward by the guide roller 3*s*, and the sheet of the supply side roll is guided to the guide roller 3*u* adjacent to the standby side roll. The conveyance direction of the sheet of the supply side roll is changed upward by the guide roller 3*u* and the sheet is guided to the moving unit 4*b*. In this way, the sheet of the supply side roll is guided to the moving unit by the guide rollers 3*s* and 3*u* in the state in which the standby side roll bypasses to the lower side.

Specifically, the guide roller 3*u* is fixed to the rotation member 3*b* such that the guide roller 3*u* is positioned below the pressing roller 4*e* on a side near the pressing roller 4*e* with the support shaft 3*d* disposed at the splice position, and on an outer side of a circular trajectory C2 (see FIG. 11) drawn by a portion positioned farthest from the rotation shaft 3*a* on the outer peripheral surface (outer peripheral surface of the standby side roll having the assumed maximum outer diameter) of the standby side roll according to the rotation of the rotation member 3*b*. Preferably, the guide roller 3*u* is fixed to the rotation member 3*b* such that the guide roller 3*u* is positioned on the opposite side to the standby side roll based on the tangential line c1 to the outer peripheral surface of the standby side roll at the pressing position P1. The conveying direction of the sheet supplied from the supply side roll is changed by the guide roller 3*u* at the outer side of the circular trajectory C2, preferably, on the opposite side to the standby side roll based on the tangential line c1, and the sheet is guided to a position between the pressing roller 4*e* and the standby side roll.

When the rotation member 3*b* is rotated from the above-described mounting position (FIG. 1) to the splice position (FIG. 11), the moving unit 4*b* is disposed at the retracted position shown in FIGS. 1 and 10 which is farthest away from the rotation shaft 3*a* in the X direction. Note that the retracted position of the moving unit 4*b* is set on the outer side of the above-described trajectory C2 (see FIG. 11). At this time, the support shaft (support shaft 3*d* in FIG. 1) supporting the standby side roll stops, and the adhesion member detector 4*d* is disposed at the retracted position.

As shown in FIG. 11, since the second guide roller 4*h* is fixed to the moving unit 4*b* on the downstream side of the pressing roller 4*e* in the conveyance direction of the sheet, the sheet being conveyed comes into contact with the peripheral surface of the pressing roller 4*e* in the state in which the standby side roll is disposed at the splice position. As a result, the moving unit 4*b* is rotated by the sheet being conveyed in the state of being positioned at the detection standby position P2, and then is less likely to affect the tension and the like of the sheet being conveyed as compared to the case where the moving unit 4*b* comes into contact with the sheet during the joining operation.

In addition, when the standby side roll is disposed at the splice position, the outer diameter of the standby side roll is detected by the outer diameter detector 4*a* while the standby side roll is rotated. On the basis of the result of detection, the moving unit 4*b* moves from the retracted position to a detectable position (detection standby position) P2 where the adhesion member H of the standby side roll can be detected by the adhesion member detector 4*d*. The detectable position P2 is set on a straight line connecting between the center of the support shaft (support shaft 3*d* in FIG. 11) that supports the standby side roll and a rotation center of the pressing roller 4*e*. When the moving unit 4*b* moves to the detectable position P2, the adhesion member detector 4*d* is rotated from the retracted position to the detected position. The detectable position P2 can secure the preset accuracy as the accuracy of the detection of the adhesion member H by the adhesion member detector 4*d*, and is set such that the adhesion member detector 4*d* at the detected position is at the farthest position from the outer peripheral surface of the standby side roll. Specifically, in the state where the adhesion member detector is disposed at the detectable position P2, the distance from the outer peripheral surface of the standby side roll to the tip portion of the adhesion member detector 4*d* at the detected position is, for example, 70 mm.

When the adhesion member detector 4*d* moves to the detectable position P2, as shown in FIG. 12, the position of the adhesion member H in the rotation direction of the standby side roll is detected by the adhesion member detector 4*d* while the standby side roll is rotated. On the basis of the result of detection, the standby side roll is rotated such that the adhesion member H is positioned within the detection range (within the range intersecting the detection axis D1) of the outer diameter detector 4*a*, and in this state, the outer diameter of the portion of the adhesion member H on the outer peripheral surface of the standby side roll is detected by the outer diameter detector 4*a*.

Next, as shown in FIG. 13, the adhesion member detector 4*d* moves to the retracted position, the support shaft (support shaft 3*d* in FIG. 12) supporting the standby side roll is rotated according to the sheet conveyance speed, and the moving unit 4*b* is started to move the standby side roll. As will be described in detail later, during the movement of the moving unit 4*b*, the position of the unit drive source 4*c*3 is controlled in a state in which the pressing roller 4*e* is positioned in an area farther away from the standby side roll than the control switching position P3 shown in FIG. 13. On the other hand, in the state where the pressing roller 4*e* is positioned in the area from the control switching position P3 to the outer peripheral surface of the standby side roll, the unit drive source 4*c*3 is torque-controlled. The control switching position P3 is set at a position farther away from the pressing position P1 than the position separated by a warped quantity of the standby side roll in the radial direction. Specifically, the control switching position P3 in the present embodiment is a position closer to the standby side roll than the detectable position P2, and is a position where the distance from the pressing roller 4*e* to the outer peripheral surface (adhesion member H) of the standby side roll is set to be 5 mm.

The state where the pressing roller 4*e* is positioned in an area farther away from the standby side roll than the control switching position P3 means the state in which the portion (tip portion) closest to the support shaft in an outer peripheral portion of the pressing roller 4*e* pressed against the standby side roll is positioned in the area farther away from the standby side roll than the control switching position P3. On the other hand, the state in which the pressing roller 4*e* is positioned in the area from the control switching position P3 to the outer peripheral surface of the standby side roll means the state in which the tip portion of the pressing roller 4*e* is positioned in the area from the control switching position P3 to the outer peripheral surface of the standby side roll.

Figure 19:
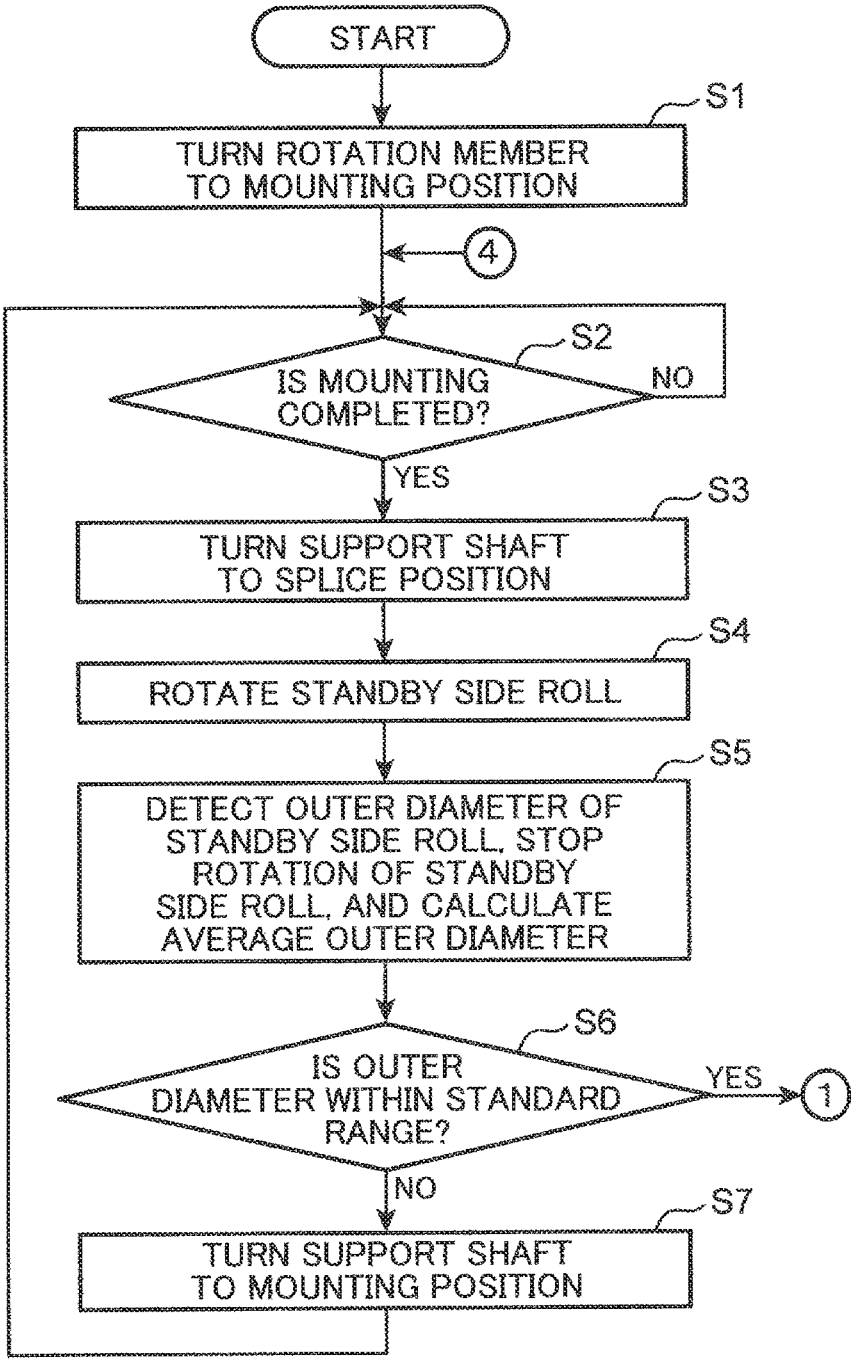
FIG. 19 is a flowchart showing a process executed by the controller of FIG. 18.
Figure 20:
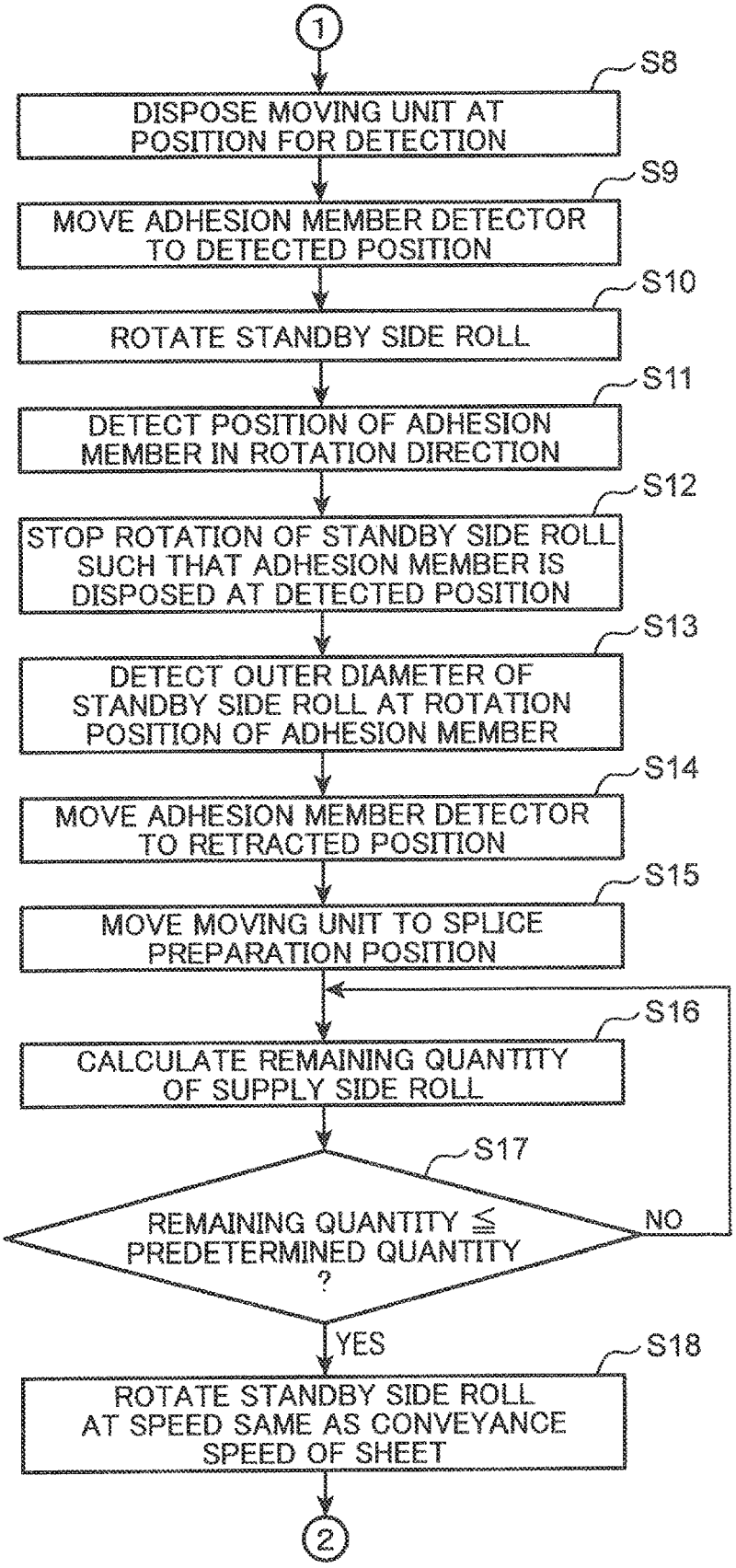
FIG. 20 is a flowchart showing the process executed by the controller in FIG. 18.

As shown in FIG. 19, during the execution period of the torque control with respect to the unit drive source 4*c*3, the pressing roller 4*e* is pressed to the pressing position P1 of the standby side roll via the sheet of the supply side roll. Thereby, the sheet of the standby side roll is joined to the sheet of the supply side roll via the adhesion member H.

In this state, the cutter 4*f* is rotated from the non-cutting position indicated by the solid line in FIG. 8 to the cutting position indicated by the two-dot chain line in FIG. 8. Thereby, the sheet of the supply side roll is cut, and the conveyance of the sheet of the standby side roll is started (the standby side roll becomes the supply side roll). When the sheet of the standby side roll is cut, the cutter 4*f* is rotated to the non-cutting position.

Figure 15:
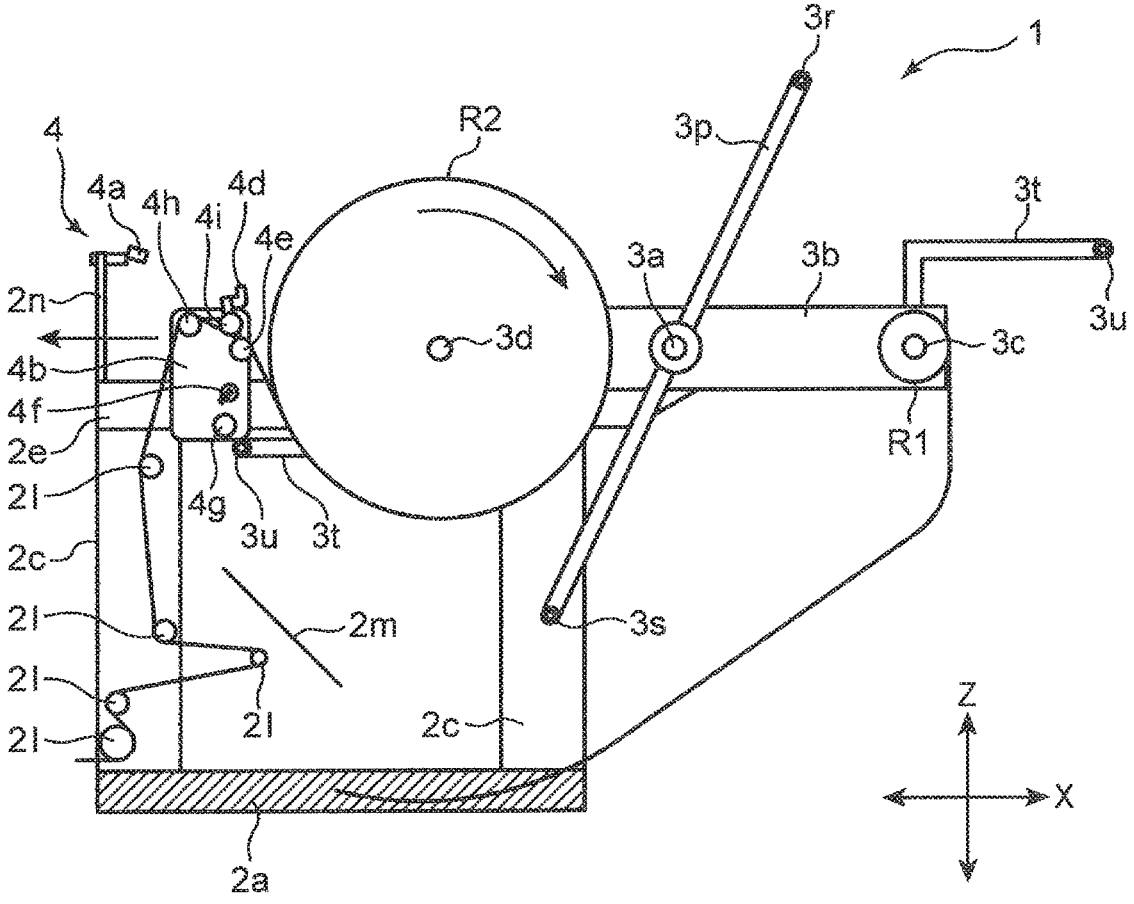
FIG. 15 is a front view showing a state after a sheet of a supply side roll is cut.

As shown in FIG. 15, when the sheet of the roll (the roll R1 in FIG. 15) which was the supply side roll is cut, the remaining portion of the sheet falls down from the moving unit 4*b*. Here, the base 2 is provided with a cover 2*m* that covers the roller 2*l*, which is positioned below the moving unit 4*b*, from above. The cover 2*m* can prevent the remaining portion of the sheet from being caught in the sheet conveyance path.

Figure 16:
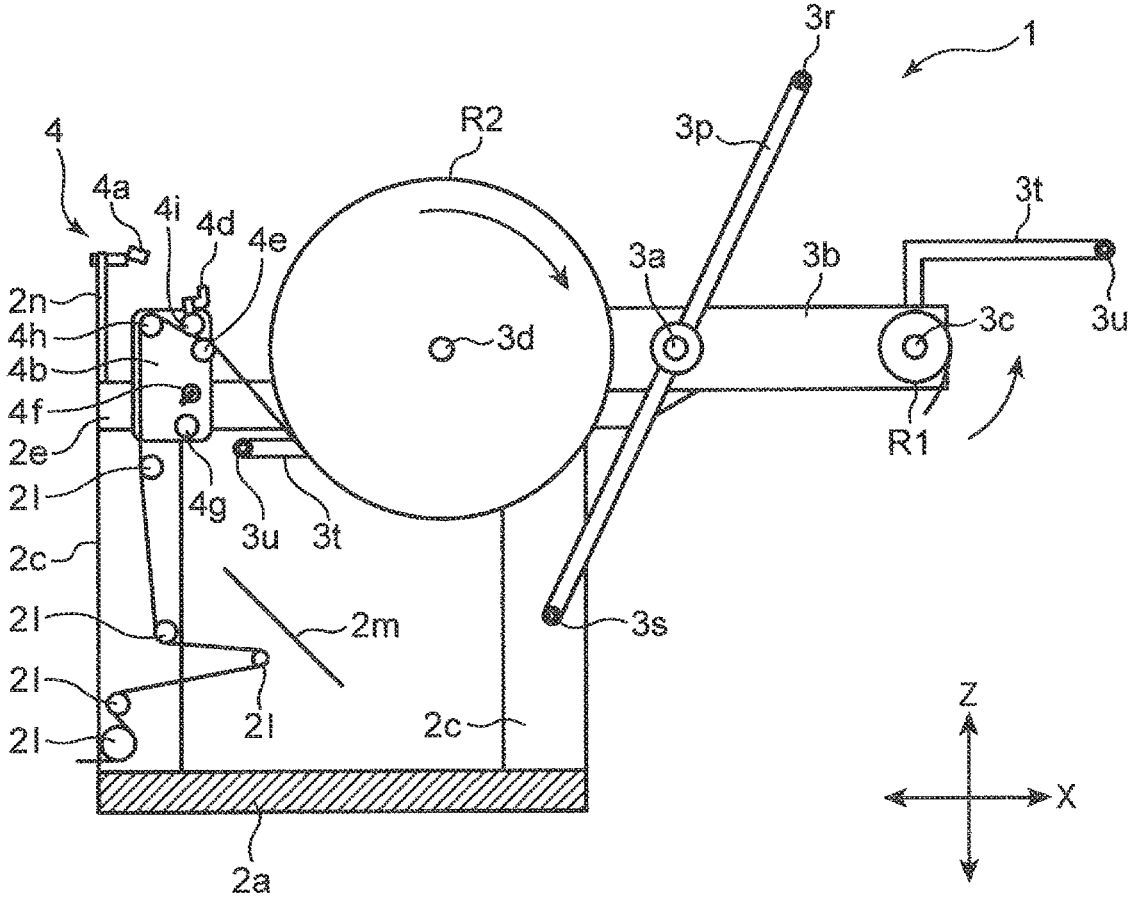
FIG. 16 is a front view showing a state in which the sheet is wound by the support shaft supporting the supply side roll.

As shown in FIG. 16, the remaining portion of the sheet is wound by the rotation of the support shaft (support shaft 3*c* in FIG. 16) supporting the roll that was the supply side roll.

As shown in FIG. 17, the rotation member 3*b* is rotated clockwise, and as a result, the support shaft (support shaft 3*c*) supporting the roll that was the supply roll is disposed at the mounting position. In this state, the discharge member 3*v* shown in FIG. 6 moves toward the tip side of the support shaft 3*c*, and as a result, the roll that was the supply side roll is discharged, and a new standby side roll is mounted on the support shaft 3*c* by a worker.

Hereinafter, the controller 5 for realizing the operation of the above-described sheet supply device will be described with reference to FIG. 18. FIG. 18 is a block diagram showing an electrical configuration of the controller 5.

The controller 5 controls the joining mechanism 4 such that the sheet of the supply side roll is joined to the sheet of the standby side roll when the remaining quantity of the sheet of the supply side roll is equal to or less than the preset remaining quantity in the state in which the sheet of the supply side roll is supplied.

The controller 5 is connected to the rotation member drive source 2*j*, an input operation unit 6, the shaft drive sources 4*k* and 4*l*, the outer diameter detector 4*a*, the unit drive source 4*c*3, the revolution drive source 4*q*, the adhesion member detector 4*d*, the cutter drive source 4*f*4, the urging force generation source 4*j*2, and the discharge drive source 2*k*. The input operation unit 6 is for inputting a set value and a command value for the sheet supply device 1.

Specifically, the controller 5 is constituted by a combination of a CPU, a RAM, a ROM, and the like, and includes a control area 5*a* that controls the operation of the sheet supply device 1 and a storage area 5*b* that is connected to the control area 5*a* and stores set items and the like.

The control area 5*a* causes information used in the control area 5*a* to store in the storage area 5*b* and executes control by the units 5*c* to 5*m* on the basis of the information stored in the storage area 5*b*. Specifically, the control area 5*a* includes a rotation member control unit 5*c*, an input content determination unit 5*d*, a shaft control unit 5*e*, an outer diameter determination unit 5*f*, a unit control unit (motor control unit) 5*g*, a revolution control unit 5*h*, an adhesion member position determination unit 5*i*, a remaining quantity calculation unit 5*j*, a cutter control unit 5*k*, an urging force control unit 5*l*, and a discharge control unit 5*m*.

The input content determination unit 5*d* determines the contents input by the input operation unit 6, and transfers a command related to the input to the rotation member control unit 5*c*, the shaft control unit 5*e*, and the storage area 5*b*. A worker inputs turn on/off of a power supply of the sheet supply device 1, an indication that the standby side roll has been mounted on the support shaft, a thickness of the sheet of the roll, and a diameter of the sheet of the roll (or the number of turns), and the like through the input operation unit 6.

The rotation member control unit 5*c* executes the rotation of the rotation member drive source 2*j* and stops the rotation, on the basis of the command from the input content determination unit 5*d* and the setting stored in the storage area 5*b*.

The shaft control unit 5*e* drives the shaft drive sources 4*k* and 4*l* and stops the driving, on the basis of the command from the input content determination unit 5*d* and the setting stored in the storage area 5*b*. In addition, the shaft control unit 5*e* has a sensor, and transfers information on the positions and rotation speeds of the support shafts 3*c* and 3*d* in the rotation direction obtained by the sensor to the adhesion member position determination unit 5*i* and the remaining quantity calculation unit 5*j*.

The adhesion member position determination unit 5*i* determines the position of the adhesion member H in the rotation direction of the standby side roll on the basis of the result of detection from the adhesion member detector 4*d* in the state in which the standby side roll is rotated by the shaft control unit 5*e*. Specifically, the position of the adhesion member H in the rotation direction of the standby side roll is determined on the basis of the result of detection from the adhesion member detector 4*d* and the shaft control unit 5*e*.

The outer diameter determination unit 5*f* determines the outer diameter of the standby side roll on the basis of the result of detection from the outer diameter detector 4*a*, and determines whether the determined outer diameter is within a preset standard range. In addition, the outer diameter determination unit 5*f* transfers information on the determined outer diameter of the standby side roll to the corresponding control unit (for example, the rotation member control unit 5*c*, the unit control unit 5*g*, and the adhesion member position determination unit 5*i*).

Here, the position of the adhesion member H in the rotation direction of the standby side roll detected by the adhesion member position determination unit 5*i* is transferred to the shaft control unit 5*e*. The shaft control unit 5*e* rotates the standby side roll on the basis of the position information from the adhesion member position determination unit 5*i* such that the adhesion member H is positioned within the detection range of the outer diameter detector 4*a*. In this state, the outer diameter determination unit 5*f* determines the outer diameter of the standby side roll in the portion where the adhesion member H is positioned, on the basis of the detection value of the outer diameter detector 4*a*.

The unit control unit 5*g* controls the unit drive source 4*c*3 on the basis of the outer diameter of the standby side roll determined by the outer diameter determination unit 5*f* such that the sheet of the supply side roll is pressed against the adhesion member H of the standby side roll. Specifically, the unit control unit 5*g* determines the detectable position P2 (see FIG. 11) of the adhesion member detector 4*d* where the adhesion member detector 4*d* can avoid contacting with the outer peripheral surface of the standby side roll and where the adhesion member detector 4*d* can detect the adhesion member H on the basis of the result of detection from the outer diameter detector 4*a*. Further, the unit control unit 5*g* controls the driving of the unit drive source 4*c*3 such that the adhesion member detector 4*d* moves to the detectable position when the detectable position P2 is closer to the support shaft disposed at the splice position than the retracted position (see FIG. 10).

Here, the outer diameter determination unit 5*f* determines the outer diameters of the standby side rolls at a plurality of locations in the rotation direction of the standby side roll on the basis of the result of detection from the outer diameter detector 4*a* in the state in which the standby side roll is rotated by the shaft drive sources 4*k* and 4*l*, and determines an average outer diameter of the standby side roll on the basis of these outer diameters. Then, the unit control unit 5*g* determines the detectable position on the basis of the average outer diameter.

Further, the unit control unit 5*g* controls the position of the unit drive source (servomotor) 4*c*3 in the state in which the pressing roller 4*e* is positioned in the area farther away from the standby side roll than the control switching position P3 (see FIG. 13) away from the outer peripheral surface of the standby side roll by a predetermined distance while the standby side roll is rotated by the shaft control unit 5*e*. On the other hand, the unit control unit 5*g* torque-controls the unit drive source 4*c*3 in the state in which the pressing roller 4*e* is positioned in the area from the control switching position P3 to the outer peripheral surface of the standby side roll, thereby pressing the pressing roller 4*e* against the outer peripheral surface of the standby side roll via the sheet of the supply side roll.

Here, the position control is control to move the pressing roller to a target position at a predetermined timing by performing feedback control using a deviation between the current position of the pressing roller determined using a sensor having a servomotor and a predetermined target position. In addition, the torque control is to control a current value supplied to the servomotor such that a torque of the servomotor determined by the current value supplied to the servomotor becomes a predetermined torque.

Further, the unit control unit 5*g* switches the control of the unit drive source 4*c*3 from the position control to the torque control while maintaining the driving of the unit drive source 4*c*3 when the pressing roller 4*e* approaches the standby side roll beyond the control switching position P3 from the area farther away from the standby side roll than the control switching position P3. Here, the control switching position P3 is set at a position (5 mm in the present embodiment) away from the standby side roll such that even if the outer peripheral surface of the standby side roll is warped, the pressing roller 4*e* does not come into contact with the warped outer peripheral surface of the standby side roll in the state in which the position of the pressing roller 4*e* is controlled.

Figure 14:
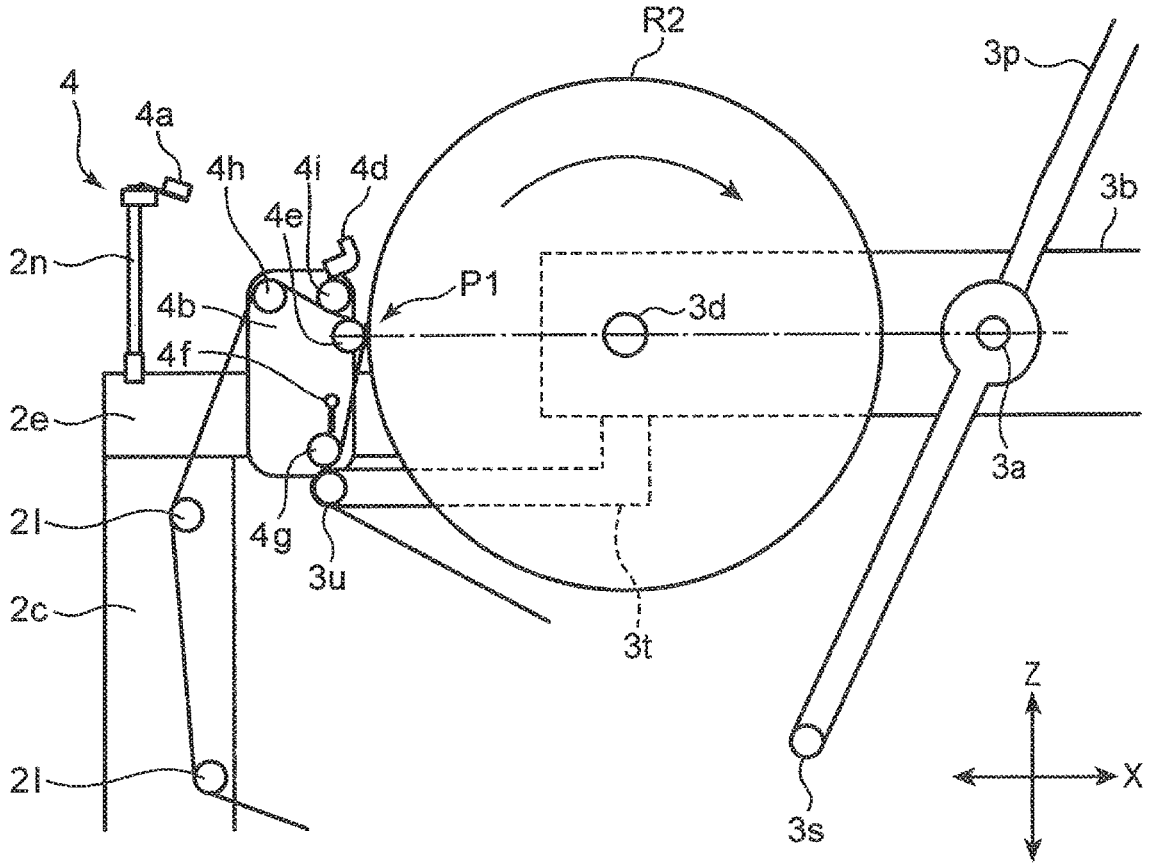
FIG. 14 is a partially enlarged front view showing a state in which the moving unit is disposed at an advance position.

Here, the adhesion member position determination unit 5*i* determines pressing timing when the adhesion member H arrives at the pressing position P1 of the standby side roll in the rotation direction of the standby side roll on the basis of the result of detection from the outer diameter detector 4*a* and the adhesion member detector 4*d*, and the rotation speed of the support shaft supporting the standby side roll obtained from the shaft control unit 5*e*. Here, the shaft control unit 5*e* controls the driving of the shaft drive sources 4*k* and 4*l* of the support shaft that supports the standby side roll such that the speed of the outer peripheral surface of the standby side roll matches the conveyance speed of the sheet of the supply side roll. Further, the unit control unit 5*g* specifies the timing for starting the movement of the pressing roller 4*e* at which the pressing roller 4*e* is pressed to the pressing position at the pressing timing, on the basis of the information on the position of the pressing roller 4*e* obtained from the unit drive source 4*c*3 and the pressing timing determined by the adhesion member position determination unit 5*i*. Specifically, immediately before the joining operation of the sheets, the moving unit 4*b* is disposed at a splice preparation position (not shown) between the detectable position P2 shown in FIG. 12 and the control switching position P3 shown in FIG. 13, the position control and the torque control of the unit drive source 4*c*3 from the splice preparation position are executed, thereby the pressing roller 4*e* is pressed to the pressing position P1 as shown in FIG. 14. Therefore, the unit control unit 5*g* determines the timing for starting the movement of the pressing roller 4*e* on the basis of the movement time of the pressing roller 4*e* from the splice preparation position to the pressing position P1 and the pressing timing. In addition, the unit control unit 5*g* starts moving the pressing roller 4*e* (driving the unit drive source 4*c*3) when the timing arrives. The pressing timing includes not only the timing when the adhesion member H arrives at the pressing position P1, but also the timing when the sheet positioned slightly upstream from the adhesion member H in the rotation direction of the standby side roll arrives at the pressing position P1. That is, the timing for starting the movement of the pressing roller is set for the purpose of joining the sheet of the supply side roll to the sheet of the standby side roll at the same time as or immediately after the pressing by the pressing roller 4*e*.

The shaft control unit 5*e* executes the control to adjust the sheet feeding quantity from the supply side roll according to the change in the tension of the sheet due to the change in a path length of the sheet on the supply roll when the rotation member 3*b* is rotated between the mounting position (see FIG. 1) and the splice position (see FIG. 11). Specifically, the shaft control unit 5*e* reduces the feeding quantity when the path length of the sheet is shortened, and increases the feeding quantity when the path length of the sheet extends. The path length is changed according to the following three factors. The first factor is a rotation angle of the rotation member 3*b*, the second factor is an outer diameter dimension of the supply side roll, and the third factor is the position of the moving unit 4*b*. The characteristics of the feeding quantity for these three factors are determined in advance, a map showing these characteristics is stored in the storage area 5*b*, and the feeding quantity is determined by using the map and the detected values of the three factors. During the rotation operation of the rotation member 3*b*, the shaft control unit 5*e* can use only the maps related to the first factor and the second factor. Further, while the moving unit 4*b* is moving, the shaft control unit 5*e* can use the map related to the third factor until the pressing roller 4*e* is pressed against the standby side roll. While the moving unit 4*b* is moving, the shaft control unit 5*e* can use the map related to the second factor (outer diameter dimension of a new supply roll) and the third factor after the pressing roller 4*e* is pressed against the standby side roll. Note that in the relationship with the disposition of the guide rollers 3*r* to 3*u* (see FIG. 1) in the support mechanism 3 of the present embodiment, the change in the path length is the largest within the predetermined angle range based on the state in which the rotation member 3*b* is rotated horizontally (the state in which one support shaft is disposed at the splice position). Therefore, the speed of the shaft control unit 5*e* is lower when the rotation member 3*b* is rotated within the above angle range than when the rotation member 3*b* is rotated within another angle range.

The remaining quantity calculation unit 5*j* calculates the remaining quantity of the sheet of the roll by using a thickness t of the sheet on the roll stored in the storage area 5*b*, a final diameter Df of the roll stored in the storage area 5*b* when the supply of the sheet is completed, a supply length L of the sheet supplied from the roll per rotation at the time of calculation, and a rotation speed v of the support shaft obtained from the shaft control unit 5*e*. The final diameter Df of the roll is a diameter of a core for a roll having a core, or the diameter of the support shaft for a roll without the core. In addition, the supply length L of the sheet is calculated, for example, from the rotation speed (peripheral speed) of the motor-driven roller 2*l* and the rotation speed v of the support shaft shown at the bottom of FIG. 1

Specifically, the remaining quantity calculation unit 5*j* calculates a current diameter Dp of the roll by dividing the supply length L of the sheet per rotation by π. Further, the remaining quantity calculation unit 5*j* may calculate the diameter Dp in consideration of a change in a conveyance path length of the sheet by the tension control roller 2*l* shown in FIG. 1. Then, the remaining quantity of the sheet is calculated based on the following equation (1).

$$[(Dp+Df)/2\times\pi]\times[(Dp-Df)/2t] \quad (1)$$

Here, the first [ ] is for calculating an average diameter of one round of the sheet wound around a plurality of times, and the last [ ] is the number of times of winding. According to Equation (1), the remaining quantity of the sheet can be calculated (estimated) by multiplying the number of windings by a circumference of the average diameter. Note that the thickness t of the sheet may be calculated by dividing a decrease value per rotation of the diameter Dp of the roll that is decreasing for each rotation of the roll by two. In addition, the remaining quantity calculation unit 5*j* can also calculate (estimate) the remaining quantity of the sheet using a mass of the standby side roll.

As described later, the controller 5 starts an operation for joining the sheet of the standby side roll when the remaining quantity of the sheet of the supply side roll calculated by the remaining quantity calculation unit 5*j* becomes equal to or less than the preset remaining quantity of the sheet. Here, the preset remaining quantity of the sheet is a remaining quantity of sheet of the supply roll when the preparation operation for joining the sheet of the standby side roll to the sheet of the supply roll is started, and is set by adding the following three times required for the preparation operation to the remaining quantity of the sheet of the supply side roll remaining after the joining operation is completed. A first time is a time from the start of the rotation of the standby side roll until the rotation speed arrives at the sheet conveyance speed. A second time is a time from the start of the advance of the moving unit 4*b* for pressing the pressing roller 4*e* to the pressing position P1 until the pressing roller 4*e* arrives at the pressing position P1. A third time is a time until the rotation of the roll which was the supply side roll stops after the sheets are joined. The remaining quantity of the sheet is set using a value obtained by adding a value obtained by multiplying the conveyance speed of the sheet by the first time and the second time, and a value obtained by multiplying the circumference of the roll by the number of rotations of the roll which was the supply roll during the third time. The standby side roll may be rotated in advance at a predetermined speed before the preparation operation, and in this case, the remaining quantity of the sheet can be set without considering the first time.

The cutter control unit 5*k* outputs an operation command to the cutter drive source 4*f*4, thereby driving the cutting blade 4*f*2 between a non-cutting position indicated by a solid line and a cutting position indicated by a two-dot chain line in FIG. 8. In addition, the cutter control unit 5*k* sets the driving timing for driving the cutting blade 4*f*2 to the cutting position based on the above-described pressing timing determined by the unit control unit 5*g*. For example, the cutter control unit 5*k* drives the cutting blade 4*f*2 to the cutting position immediately after the pressing timing (for example, after 60 milliseconds), and holds the cutting blade 4*f*2 at the cutting position for a predetermined period (for example, 60 milliseconds).

The urging force control unit 5*l* outputs the operation command to the urging force generation source 4*j*2, thereby switching the urging mechanism 4*j* to a supply state in which compressed air blows from the air nozzle 4*j*1 according to the cutting timing of the sheet by the cutter 4*f*. Specifically, the urging force control unit 5*l* sets the urging mechanism 4*j* in the supply state during a predetermined period including the cutting timing of the sheet. Further, the urging force control unit 5*l* may control the urging mechanism 4*j* such that the urging mechanism 4*j* is in the supply state during a period from before the predetermined time of the cutting timing to after the lapse of the predetermined time. In the present embodiment, the urging force control unit 5*l* switches the urging mechanism 4*j* from the stop state to the supply state simultaneously with the driving timing of the cutter blade 4*f*2 by the cutter control unit 5*k*, and maintains the supply state for the predetermined period (for example, 100 seconds). The urging force control unit 5*l* sets the switching timing of the urging mechanism 4*j* based on the above-described pressing timing determined by the unit control unit 5*g*.

The discharge control unit 5*m* outputs an operation command to the discharge drive source 2*k* to control the discharge mechanism between a non-discharge position indicated by a solid line and a discharge position indicated by a two-dot chain line in FIG. 6.

The revolution control unit 5*h* controls the revolution drive source 4*q* such that the adhesion member detector 4*d* moves between the detected position (see FIG. 12) and the retracted position (see FIG. 13).

Hereinafter, the processing executed by the controller 5 will be described with reference to FIGS. 18 to 22. In the following description, a case in which the current sheet is supplied from the roll R1 supported by the support shaft 3*c* and a new roll R2 is mounted on the support shaft 3*d*, that is, a case in which the roll R1 is the supply side roll and the roll R2 is the standby side roll will be described. In addition, it is assumed that the support shaft 3*c* is rotatably driven at the stage before the execution of the processing shown in FIG. 19, and thus the sheet of the supply side roll R1 is supplied.

Referring to FIG. 19, when the input operation unit 6 is operated by a worker to allow the sheet supply device 1 to perform the joining operation of the sheet, the rotation member 3*b* is rotated such that the support shaft 3*d* is disposed at the mounting position shown in FIG. 1 (step S1). A worker mounts a new standby side roll R2 on the support shaft 3*d* rotated to the mounting position in this way.

After the new standby side roll R2 is mounted, when the input operation unit 6 for inputting the completion of the mounting by the worker is operated (YES in step S2), the rotation member 3*b* is rotated such that the support shaft 3*d* is disposed at the splice position shown in FIG. 11 (step S3).

In this state, the standby side roll R2 is rotated (step S4). Further, the outer diameter detector 4*a* starts detecting the outer diameter of the standby side roll R2, the rotation of the standby side roll R2 is stopped at the timing when the outer diameter of the standby side roll R2 is detected during one rotation of the standby side roll R2, and the average value of the outer diameter of the standby side roll R2 is calculated on the basis of the detection value of the outer diameter (step S5).

It is determined whether or not the average value of the outer diameter of the standby side roll R2 calculated in this way is within a predetermined standard range (step S6). Here, if it is determined that the average value is out of the standard range (NO in step S6), the rotation member 3*b* is rotated such that the support shaft 3*d* is disposed at the mounting position shown in FIG. 1 (step S7), and the process returns to the above-described step S2. That is, when the outer diameter of the standby side roll R2 is out of the standard range, the standby side roll R2 is not used to be replaced with (mounted on) another standby side roll R2 after the support shaft 3*d* is disposed at the mounting position.

On the other hand, if it is determined that the average value of the outer diameter of the standby side roll R2 is within the standard range (YES in step S6), the moving unit 4*b* moves to a position for detection by the outer diameter detector 4*a* and the adhesion member detector 4*d* (step S8).

Specifically, in step S8, the detectable position is calculated on the basis of the average value of the outer diameter of the standby side roll R2 calculated in step S5. Further, when the position of the moving unit 4*b* corresponding to the detectable position is closer to the standby side roll R2 than the retracted position shown in FIG. 1, the moving unit 4*b* moves to a position corresponding to the detectable position P2 (FIG. 12). On the other hand, when the position of the moving unit 4*b* corresponding to the detectable position is the retracted position or is farther from the standby side roll R2 than the retracted position, the moving unit 4*b* waits at the retracted position.

Next, the adhesion member detector 4*d* is rotated from the retracted position shown in FIG. 10 to the detected position shown in FIGS. 11 and 12 (step S9), and the rotation of the standby side roll R2 is started (step S10), and in this state, the position of the adhesion member H in the rotation direction of the standby side roll R2 is detected by the adhesion member detector 4*d* (step S11).

The rotation of the standby side roll R2 stops such that the adhesion member H is disposed within the detection range of the outer diameter detector 4*a* as indicated by a two-dot chain line in FIG. 12 (such that the adhesion member H is positioned within the range that intersects the detection axis D1) on the basis of the detected position of the adhesion member H in the rotation direction (step S12).

In this state, the outer diameter of the adhesion member H in the standby side roll R2 is detected by the outer diameter detector 4*a* (step S13).

Next, as shown in FIG. 13, the adhesion member detector 4*d* moves to the retracted position (step S14), and the moving unit 4*b* advances to the splice preparation position (step S15). Here, the splice preparation position is a position between the detectable position P2 shown in FIG. 12 and the control switching position P3 shown in FIG. 13, and is a position preset as a position where the pressing roller 4*e* does not come into contact with the standby side roll R2 even if the outer diameter of the standby side roll R2 varies in the rotation direction. For example, the splice preparation position is the position of the moving unit 4*b* where the distance from the pressing roller 4*e* to the outer diameter of the standby side roll R2 is 50 mm.

Next, the remaining quantity of the supply side roll R1 is calculated (step S16), and it is determined whether the remaining quantity is equal to or less than the preset remaining quantity (predetermined quantity) (step S17).

If it is determined in step S17 that the remaining quantity is not equal to or less than the predetermined quantity, the remaining quantity of the supply side roll R1 is repeatedly calculated based on the rotation speed v of the support shaft 3*c* and the conveyance speed of the sheet (step S16), and it is determined whether the remaining quantity is equal to or less than the predetermined quantity (step S17).

Here, if it is determined that the remaining quantity is equal to or less than the predetermined quantity, the rotation of the standby side roll R2 is started so as to have the same speed as the conveyance speed of the sheet of the supply side roll R1 (step S18).

In step S19, the driving timings of the moving unit 4*b*, the cutter 4*f*, and the urging mechanism 4*j* are set. Specifically, the unit control unit 5*g* sets the driving timing of the moving unit for pressing the pressing roller 4*e* to the pressing position P1 via the adhesion member H. The cutter control unit 5*k* sets the driving timing for driving the cutting blade 4*f*2 to the cutting position according to the pressing timing of the pressing roller 4*e*. Further, the urging force control unit 5*l* sets the driving timing of the urging mechanism 4*j* that blows out the compressed air according to the sheet cutting timing.

Next, it is determined whether or not the driving timing of the moving unit 4*b* has come (step S20), and if it is determined that the driving timing has arrived, the moving unit 4*b* advances from a splice standby position (not shown) by position control (step S21).

When the moving unit 4*b* starts advancing in step S21, it is determined whether the moving unit 4*b* has arrived at the control switching position P3 shown in FIG. 13 (step S22).

Here, if it is determined that the moving unit 4*b* has not arrived at the control switching position P3, the moving unit 4*b* continues to advance by the position control, while if it is determined that the moving unit 4*b* has arrived at the control switching position P3, the control for advance of the moving unit 4*b* is switched to the torque control (step S23).

In parallel with steps S20 to S23, it is determined whether or not the driving time of the cutter 4*f* has come (step S24).

Here, if it is determined that the driving time of the cutter 4*f* has arrived, the cutter 4*f* is driven to the cutting position (step S25). Thereby, the sheet of the supply side roll R1 is cut, and the supply of the sheet of the standby side roll R2 is started.

In parallel with steps S20 to S23 and steps S24 to S25, it is determined whether or not the driving time of the urging mechanism 4*j* has come (step S26).

If it is determined that the driving time of the urging mechanism 4*j* has arrived, the urging mechanism 4*j* applies the urging force (step S27). Thereby, after the sheet of the supply side roll R1 is cut by the cutter 4*f*, the remaining portion of the sheet is urged in a direction (downward) away from the pressing roller 4*e* to be able to prevent the sheet from being caught in a supply path of the sheet.

After executing the processes related to steps S20 to S23, steps S24 to S25, and steps S26 to S27, it is determined whether or not the movement of the moving unit 4*b* to the pressing position, the driving of the cutter 4*f* to the cutting position, and the application of the urging force from the urging mechanism 4*j* are completed, in other words whether or not the joining operation is completed (step S28).

If it is determined in step S28 that the joining operation is not completed, the process waits for the completion of all the processes in steps S20 to S27, while if it is determined that the joining operation is completed, the role setting is changed (step S29). Specifically, in step S29, the roll R1 is set as the next standby side roll, and the roll R2 is set as the next supply side roll.

Next, the moving unit 4*b* retracts by the torque control (step S30), and when the moving unit 4*b* arrives at the control switching position P3 (see FIG. 13) (YES in step S31), the moving unit 4*b* is temporarily stopped (step S32).

Then, the moving unit 4*b* retracts by the position control (step S33), and when the moving unit 4*b* arrives at the retracted position (see FIG. 1) (YES in step S34), the moving unit 4*b* is stopped (step S35).

Further, in parallel with the steps S30 to S35, the cutter 4*f* is driven at the non-cutting position (step S36), the rotation of the support shaft 3*c* is stopped (step S37), and the application of the urging force is stopped (step S38).

Then, it is determined whether or not all the processes in steps S30 to S38 are completed (step S39). Here, if it is determined that some of the processes in steps S30 to S38 are not completed, the process waits until all the processes in steps S30 to S38 are completed.

On the other hand, if it is determined in step S39 that all the processes in steps S30 to S38 are completed, the support shaft 3*c* is reversed by a predetermined angle (step S40). Thereby, the remaining portion of the sheet cut by the cutter 4*f* is wound around the support shaft 3*c* from the state shown in FIG. 15, as shown in FIG. 16.

Next, the rotation member 3*b* in the state of FIG. 16 is rotated clockwise in FIG. 16 about the rotation shaft 3*a*, so the support shaft 3*d* is disposed at the mounting position (see FIG. 1) (step S41).

In this state, as shown in FIG. 6, the discharge mechanism is driven from the non-discharge position indicated by a solid line to the discharge position indicated by a two-dot chain line (step S42). Thereby, the roll R1 is discharged from the support shaft 3*c* disposed at the mounting position, and then, a worker is allowed to attach a new roll. Then, the process returns to step S2.

As described above, as shown in FIG. 14, the pressing roller 4*e* is moved such that the center of the pressing roller 4*e* is movable on the straight line passing through the center of the rotation shaft 3*a* and the center of the support shaft 3*d* disposed at the splice position. Thereby, since the pressing force from the pressing roller 4*e* can be transmitted to the rotation shaft 3*a* along the radial direction of the rotation shaft 3*a*, it is possible to prevent the pressing force from the pressing roller 4*e* from working in a bending direction of the rotation member 3*b* supported by the rotation shaft 3*a*, and prevent the rotation member 3*b* from working in a rotation direction.

Therefore, the sheets can be accurately joined by accurately transmitting the force for joining the sheets from the pressing roller 4*e* to the standby side roll R2.

Since the pressing roller 4*e* is moved in the horizontal direction, the influence of the self-weight of the pressing roller 4*e* on the movement of the pressing roller 4*e* can be reduced.

Therefore, it is possible to accurately manage the pressing force applied to the standby side roll R2 by the pressing roller 4*e*.

As shown in FIGS. 11 and 14, the sheet from the supply side roll R1 is once guided to a position outside a circular trajectory C2 drawn by the outer peripheral surface of the standby side roll R2 according to the rotation of the rotation member 3*b*, and then the sheet is guided between the pressing roller 4*e* and the standby side roll R2 from the guide roller 3*u*. As a result, it is possible to prevent the middle part of the sheet guided between the pressing roller 4*e* and the standby side roll R2 from the guide roll 3*u* from coming into contact with the outer peripheral surface of the standby side roll R2.

As shown in FIG. 11, the sheet of the supply side roll R1 is guided between the standby side roll R2 and the pressing roller 4*e* through the bottom of the standby side roll R2, and the sheet of the supply side roll R1 is cut under the center of the standby side roll R2. For this reason, as shown in FIG. 15, the end portion of the sheet of the supply side roll R1 after the cutting falls under both rolls R1 and R2, and as a result, it is possible to prevent the sheet of the supply side roll R1 from being caught in the standby side roll R2.

As shown in FIG. 1, when the standby side roll R3 is mounted on the support shaft 3*d* in the state in which the supply side roll R1 is supported on the support shaft 3*c*, it is possible to perform the mounting operation of the standby side roll in a large space away from the shaft support parts 2*f* and 2*g* (see FIG. 3) and the unit support part (parts extending from the shaft support parts 2*f* and 2*g* toward the moving unit 4*b* in the base 2 [mounting plate 2*a*, posts 2*b* and 2*c*, beams 2*d* and 2*e*, and rails 2*h* and 2*i*]) in a side view.

Figure 23:
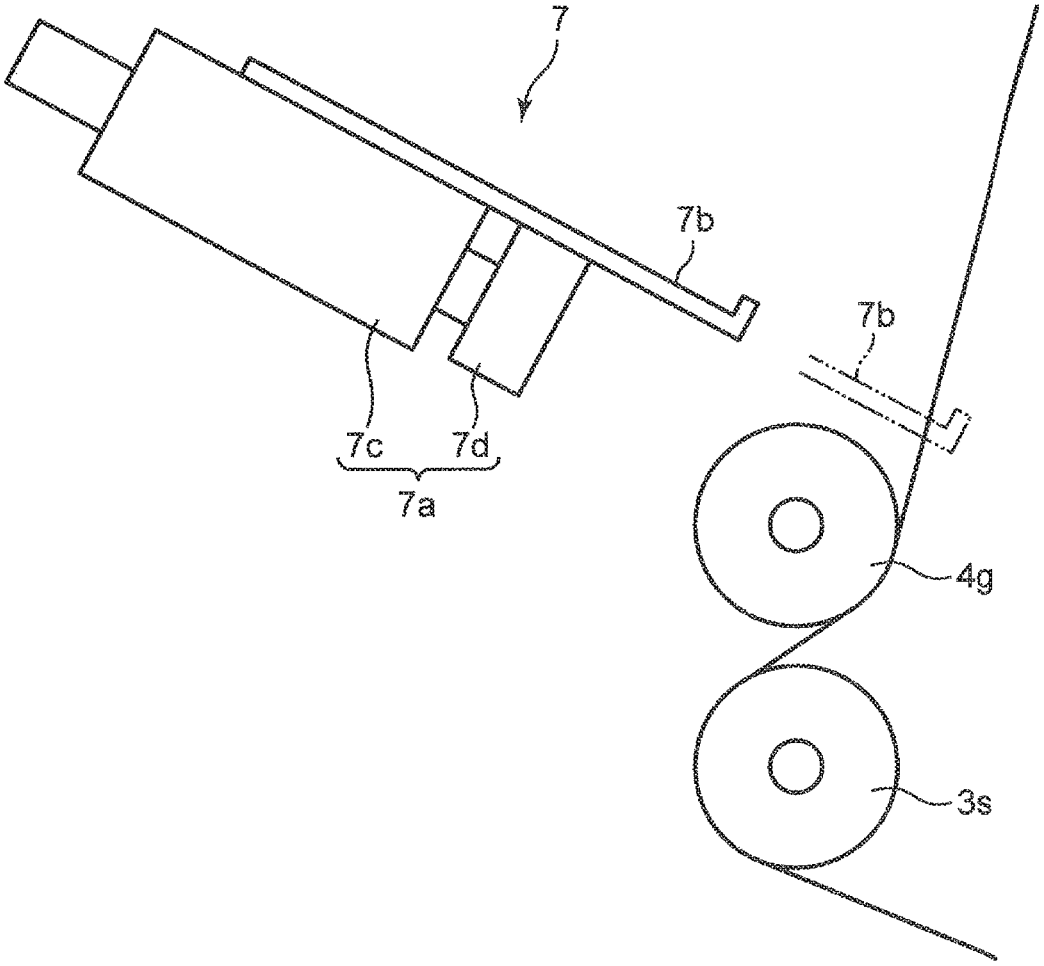
FIG. 23 is a partially enlarged front view showing an urging mechanism according to another embodiment.

In addition, in the above embodiment, although the structure which blows out the compressed air is employed as the urging mechanism 4*j*, the urging mechanism 4*j* is not limited to the structure of the above embodiment. For example, as shown in FIG. 23, the urging mechanism 7 that presses the sheet mechanically may be employed as the urging mechanism 4*j*.

Specifically, the urging mechanism 7 includes an air cylinder 7*a* attached to the moving unit 4*b* and a pressing plate 7*b* for pressing a sheet.

The air cylinder 7*a* has a cylinder main body 7*c* fixed to the moving unit 4*b*, and a rod 7*d* displaceable with respect to the cylinder main body 7*c*, and the rod 7*d* can be expanded and contracted with respect to the cylinder main body 7*c* by supplying the compressed air from the urging force generation source (not shown).

The pressing plate 7*b* is fixed to the rod 7*d* so as to follow the expansion and contraction of the rod 7*d*.

As described above, the urging mechanism 7 controls the supply and exhaust of the compressed air from the urging force generation source (not shown), and as a result, is configured to be switchable between a supply state (state indicated by a two-dot chain line in FIG. 23) in which a force is applied to the sheet in a direction away from the pressing position P1 (see FIG. 8) and a stop state in which the application of the force is stopped.

Hereinafter, a sheet supply method using the above-described sheet supply device 1 will be described. Hereinafter, the case where the roll R1 in FIG. 1 is the supply side roll and the roll R2 is the standby side roll will be described.

The sheet supply method includes a mounting step, a supply step, a splice preparation step, and a joining step.

In the mounting step, the standby side roll R2 is mounted on the support shaft 3*d* mounted at the mounting position shown in FIG. 1.

In the supply step, prior to the mounting step, the sheet of the supply side roll R1 supported at the center position by the support shaft 3*c* is supplied by the driving of the shaft drive source 4*l*.

In the splice preparation step, when the remaining quantity of the sheet of the supply side roll R1 is equal to or less than the preset remaining quantity, the rotation member 3*b* is rotated such that the support shaft 3*d* is disposed at the splice position as shown in FIG. 11.

Figure 21:
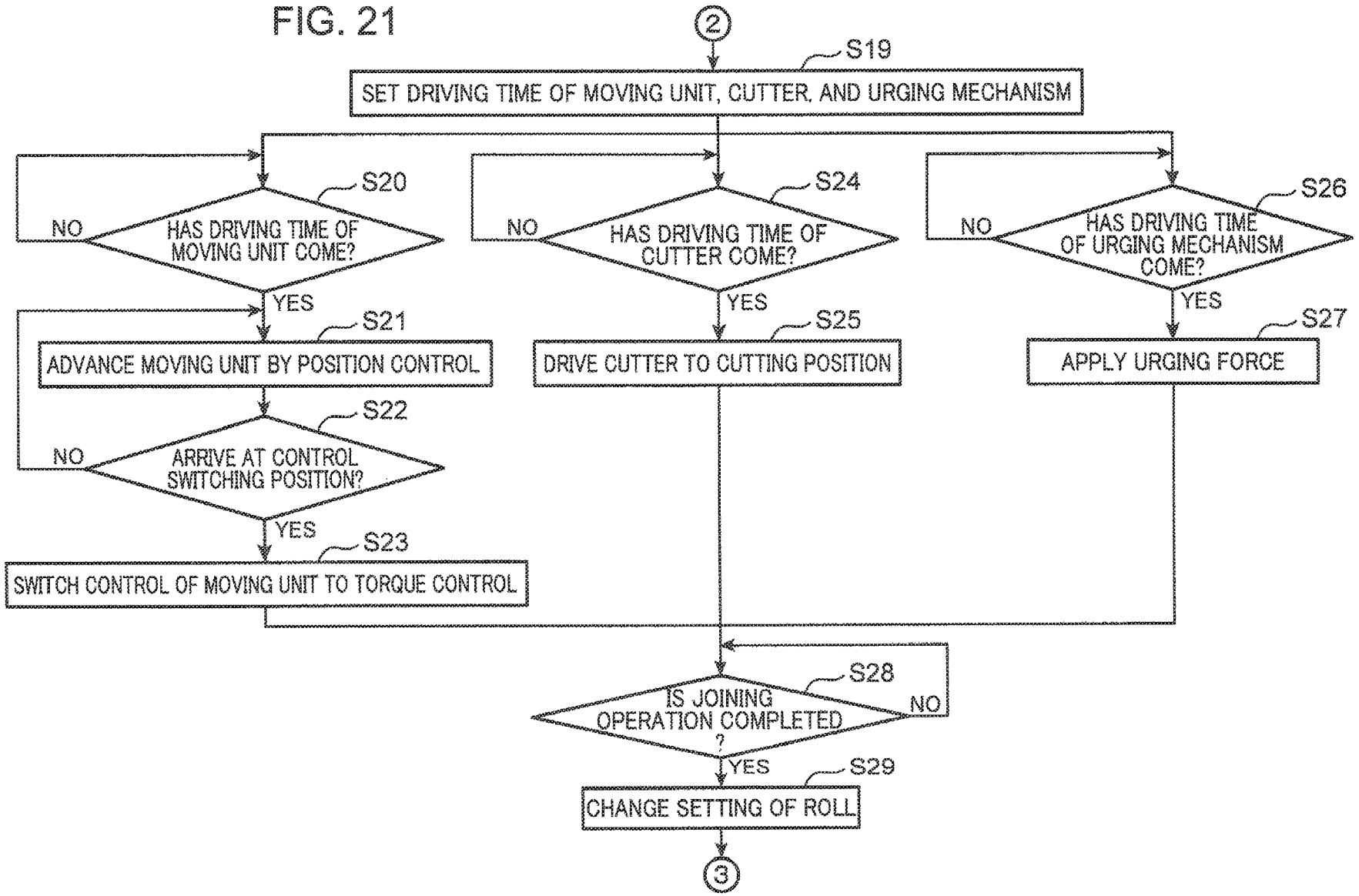
FIG. 21 is a flowchart showing the process executed by the controller in FIG. 18.
Figure 22:
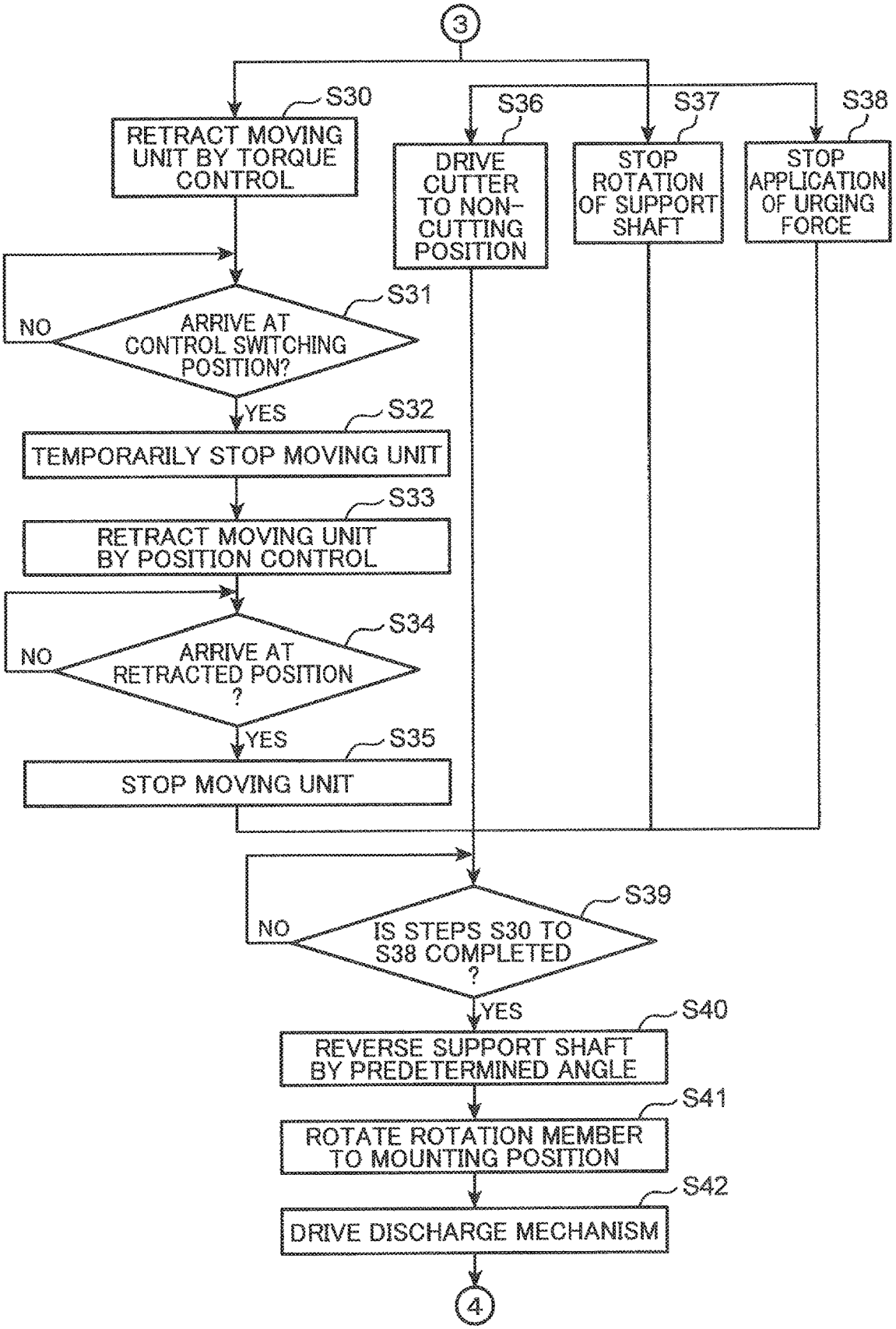
FIG. 22 is a flowchart showing the process executed by the controller in FIG. 18.

In the joining step, in a state after the splice preparation step is performed, as shown in FIG. 14, the pressing roller 4*e* moves such that the center of the pressing roller 4*e* moves on the straight line passing through the center of the rotation shaft 3*a* and the center of the support shaft 3*d* disposed at the splice position by the joining mechanism 4 (steps S20 to S23 in FIG. 21). As a result, the sheet of the supply side roll R1 is pressed against the outer peripheral surface of the standby side roll R2, and the sheet of the standby side roll R2 is joined to the sheet of the supply side roll R1. Then, in the joining step, as indicated by a two-dot chain line in FIG. 8, after the sheet of the supply side roll R1 is joined to the sheet of the standby side roll R2, the sheet of the supply side roll R1 is cut by the cutter 4*f*.

Further, in the joining process, the position control of the unit drive source 4*c*3 is executed in the state in which the pressing roller 4*e* is positioned in the area farther away from the standby side roll R2 than the control switching position P3 (see FIG. 13) away from the outer peripheral surface of the standby side roll R2 by a predetermined distance while the standby side roll R2 is rotated by the shaft drive source (second shaft drive source) 4*k*. On the other hand, in the joining step, the torque control of the unit drive source 4*c*3 is executed in the state in which the pressing roller 4*e* is positioned in the area from the control switching position P3 to the outer peripheral surface of the standby side roll R2, thereby pressing the pressing roller 4*e* against the outer peripheral surface of the standby side roll R2 via the sheet of the supply side roll R1.

Thus, in the joining step, the moving unit 4*b* moves in a direction approaching the standby side roll R2. As a result, as shown in FIG. 8, the second guide roller 4*h* fixed to the moving unit 4*b* is disposed on the opposite side to the standby side roll R2 based on the tangential line C1 with respect to the outer peripheral surface of the standby side roll R2 at the pressing position P1. Thereby, the sheet is guided such that the sheet is guided from the pressing roller 4*e* in a direction away from the standby side roll R2.

Further, in the joining step, as shown in FIG. 8, by moving the moving unit 4*b* in the direction approaching the standby side roll R2, the pressing roller 4*e* is pressed against the pressing position, and the sheet drawn from the supply side roll R1 on the upstream side of the pressing position P1 in the conveyance direction of the sheet is guided to the pressing position P1 by the first guide roller 4*g*. Further, the force in the direction away from the pressing position P1 is applied to the portion of the sheet of the supply side roll R1 on the upstream side in the conveyance direction with respect to the cutting position by the cutter 4*f* according to the sheet cutting timing by the cutter 4*f*.

Although the example in which the supply step is performed prior to the mounting step has been described, for example, when the sheet supply device 1 is started, the mounting step may be performed before the supply step.

Note that the present invention is not limited to the above embodiment, and for example, the following aspects can be adopted.

In the above embodiment, although the double-sided tape is illustrated as the adhesion member H, the adhesion member H is not limited to the double-sided tape, and is provided on the outer peripheral surface of the standby side roll, and may allow the adhesion from the outside of the sheet of the supply side roll while fastening an end of the sheet on the outer peripheral surface of the standby side roll. For example, the adhesion member H does not have a base material such as a tape, but may be an adhesive. Further, a tape having a delamination structure in which a plurality of layers are laminated so as to be peelable and which has an adhesive material on both front and back surfaces thereof can also be adopted. Specifically, the tape having the delamination structure is stuck on the outer peripheral surface of the standby side roll, and the end portion of the sheet is bonded to the outer surface of the tape so that a part of the outer surface of the tape is exposed. In this state, by pressing the sheet of the supply side roll against the exposed portion of the tape, an outermost layer of the tape having the delamination structure is peeled from an inner layer thereof, and thus the sheets can be joined.

In the above embodiment, although the configuration in which the support shafts 3*c* and 3*d* are provided at every 180° about the rotation shaft 3*a* with respect to the rotation member 3*b* has been described, the number of support shafts to be attached to the rotation member 3*b* is not limited to two, but may be in plural. For example, it is also possible to apply the rotation member 3*b* provided with three support shafts every 120° about the rotation shaft 3*a*.

Although the configuration in which the moving unit 4*b* moves in a horizontal direction has been described, the moving direction of the moving unit 4*b* is not limited to the horizontal direction. For example, the moving unit 4*b* can be configured to move in a vertical direction or in a direction inclined with respect to the horizontal direction and the vertical direction. However, it is preferable to set the movement path of the moving unit 4*b* such that a space for the remaining portion of the sheet cut by the cutter 4*f* to fall can be formed below the moving unit 4*b*.

Although the support shafts 3*c* and 3*d* supported (extending in the Y direction from the rotation member 3*b*) in a cantilever manner with respect to the rotation member 3*b* have been described, both ends of the support shafts 3*c* and 3*d* may be supported. However, as in the above embodiment, since one end of each of the support shafts 3*c* and 3*d* is a free end, the rolls R1 and R2 can be easily mounted from the free end.

Although the urging mechanism 4*j* (FIG. 8) for blowing the compressed air and the urging mechanism 7 (FIG. 23) for pressing the pressing plate 7*b* have been described, the urging mechanism is not limited to these configurations. For example, the drive source for rotating the guide roller (for example, the first guide roller 4*g* in FIG. 8) in a direction opposite to the conveyance direction of the sheet is applied as the urging mechanism, the guide roller being provided on the upstream side of the cutter 4*f* in the conveyance path of the sheet.

The configuration in which the cutter 4*f* is driven to the cutting position immediately after the pressing timing of the pressing roller 4*e* to the pressing position P1 has been described, but the timing of driving the cutter 4*f* to the cutting position is not limited thereto. For example, the cutter 4*f* can be driven to the cutting position simultaneously with the pressing timing. Thereby, after the joining operation, the length of the portion following the sheet of the standby side roll in the sheet of the supply side roll can be shortened.

Although the configuration in which the average value of the outer diameter is calculated based on the result of detection from the outer diameter detector 4*a* while the standby side roll is rotated once has been described, the method of calculating the outer diameter of the standby side roll is not limited thereto. For example, in the state in which the rotation of the standby side roll is stopped, the outer diameter of the standby side roll at one location in a circumferential direction may be calculated based on the result of detection from the outer diameter detector 4*a*. Further, when the average value of the outer diameter is calculated, the rotation range of the standby side roll is not one rotation but may be shorter (for example, shortened to a half rotation) than the one rotation.

Although the configuration in which the pressing roller 4*e* and the adhesion member detector 4*d* are each attached to the common moving unit 4*b* has been described, the pressing roller 4*e* and the adhesion member detector 4*d* may be attached to different configurations that can be contact with and separated from the standby side roll.

Although the example in which the detection axis D2 (see FIG. 12) of the adhesion member detector 4*d* is disposed perpendicular (perpendicular to the support shafts 3*c* and 3*d*) to the outer peripheral surface of the standby side roll has been described, the detection axis D2 may not be disposed perpendicular to the standby side roll.

Furthermore, the example in which the adhesion member detector 4*d* is rotatable between the detected position (see FIG. 12) and the retracted position (see FIG. 13) by the revolution member 4*n* has been described, but the attachment method of the adhesion member detector 4*d* is not limited thereto. For example, the adhesion member detector 4*d* may be fixed at a position where the detection axis D2 intersects the outer peripheral surface of the standby side roll under the premise that the adhesion member detector 4*d* is disposed at a position deviating from the movement path of the pressing roller 4*e*.

In the above embodiment, when the moving unit 4*b* moves to the control switching position P3, the switching from the position control to the torque control is performed without stopping the moving unit 4*b* (steps S21 to S23 in FIG. 21), but the control of the moving unit 4*b* is not limited thereto. For example, it is also possible to stop the moving unit 4*b* at the control switching position P3 and then perform the switching from the position control to the torque control.

In the above embodiment, the switching timing from the position control to the torque control is calculated while the moving unit 4*b* is waiting at the splice preparation position (not shown) (step S15 in FIG. 20 and step S19 in FIG. 21), but the calculation time of the switching timing is not limited thereto. For example, under the premise that the pressing roller 4*e* is temporarily stopped when the pressing roller 4*e* arrives at the control switching position P3, the start timing of the torque control may be determined when the pressing roller 4*e* arrives at the control switching position P3.

In the above embodiment, the configuration in which the sheet of the supply side roll (the roll R1 in FIG. 11) is guided between the standby side roll and the pressing roller 4*e* through below the standby side roll (the roll R2 in FIG. 11) has been described, but the path for guiding the sheet to the pressing position P1 is not limited thereto. For example, the configuration in which the sheet of the supply side roll is guided between the standby side roll and the pressing roller 4*e* though over the standby side roll may be employed.

In the embodiment, as shown in FIG. 8, in the moving unit 4*b*, the first guide roller 4*g* is provided on the upstream side of the pressing position P1 in the conveyance direction of the sheet, but the second guide roller 4*h* is provided on the downstream side of the pressing position P1. The angle θ1 formed by the sheet from the first guide roller 4*g* to the pressing position P1 and the tangential line C1 is smaller than the angle θ2 formed by the sheet from the pressing position P1 to the second guide roller 4*h* and the tangential line C1. However, the angle θ1 may be equal to or larger than the angle θ2.

The point where the urging mechanism 4*j* is switched from the stopped state to the supply state at the same time as the driving timing of the cutting blade 4*f*2 (steps S24 to S27) has been described. However, the switching of the urging mechanism 4*j* from the stop state to the supply state according to the driving timing of the cutting blade 4*f*2 includes that the urging mechanism 4*j* is in the supply state during a predetermined period including the driving timing of the cutting blade 4*f*2, and after the driving of the cutting blade 4*f*2, the urging mechanism 4*j* is in the supply state during a predetermined period from timing before the remaining portion of the sheet of the supply side roll follows the sheet of the standby side roll and is caught in the conveyance path.

Although the configuration in which the force from the urging mechanism 4*j* is applied to the portion of the sheet opposite to the cutter 4*f* based on the first guide roller 4*g* on the sheet has been described, the position where the force from the urging mechanism 4*j* is applied may be a portion on the upstream side in the conveyance direction with respect to the cutting position of the sheet by the cutter 4*f* For example, as shown in FIG. 23, the force from the urging mechanisms 4*j* and 7 can be applied to a position on the upstream side in the conveyance direction with respect to the cutting position by the cutter 4*f* and on the downstream side of the first guide roller 4*g*.

The configuration in which the distance from the portion of the sheet to which the force from the urging mechanism 4*j* is applied to the first guide roller 4*g* is set smaller than the distance from the first guide roller 4*g* to the cutting position by the cutter 4*f* has been described, but the distance is not particularly limited.

Although the urging mechanism 4*j* for applying a downward force to the sheet has been described, the direction of the force from the urging mechanism may be a direction away from the pressing position P1.

In the above embodiment, the distance from the portion of the sheet to which the force is applied by the urging mechanism 4*j* to the first guide roller 4*g* is smaller than the distance from the first guide roller 4*g* to the cutting position by the cutter 4*f*. However, the portion of the sheet to which the force from the urging mechanism 4*j* is applied may be positioned on the upstream side away from the first guide roller 4*g*. For example, the force from the urging mechanism 4*j* may be applied to a portion of a sheet on a further upstream side with respect to the guide roll 3*s*.

In order to obtain the result of detection from the outer diameter detector 4*a* in the state in which the position of the adhesion member H determined by the adhesion member position determination unit 5*i* is positioned within the detection range of the outer diameter detector 4*a*, the following process is executed in the embodiment.

On the basis of the position of the adhesion member H determined by the adhesion member position determination unit 5*i*, the driving of the shaft drive sources 4*k* and 4*l* is controlled by the shaft control unit 5*e* such that the adhesion member H is positioned within the detection range of the outer diameter detector 4*a*, and in this state, the outer diameter determination unit 5*f* determines the diameter at the position of the adhesion member H in the roll using the result of the outer diameter detector 4*a*.

Alternatively, the following process can be performed. The driving of the drive sources 4*k* and 4*l* is controlled in advance by the shaft control unit 5*e*, and the outer diameter for each rotation angle position of the roll is detected by the outer diameter detector 4*a* and stored in the storage area 5*b* (hereinafter, the stored outer diameter is referred to as outer diameter data). The outer diameter determination unit 5*f* can determine the outer diameter of the roll on the basis of the outer diameter data and the rotation angle position of the roll corresponding to the position of the adhesion member H determined by the adhesion member position determination unit 5*i*, and determine a partial outer diameter of the adhesion member H in the roll by using this outer diameter as the result of detection from the outer diameter detector 4*a* in the state in which the adhesion member H is positioned within the detection range of the outer diameter detector 4*a*.

Further, the movement of the cutter 4*f* is not limited to the movement by the rotation, and may be a movement (for example, linear movement) in a posture maintaining a predetermined angle with respect to the sheet.

The urging mechanism 4*j* may not be provided in the moving unit 4*b*. For example, the urging mechanism 4*j* may be provided on the base 2 or the support mechanism 3. In this case, in a state where the support shaft is disposed at the splice position, the urging mechanism 4*j* can be disposed at a position where a force can be applied to a portion on the upstream side in the conveyance direction of the sheet based on the guide roll 3*s*.

Note that the specific embodiments described above mainly include inventions having the following configurations.

In order to solve the above problem, the present invention provides a sheet supply device for sequentially supplying a sheet from a plurality of rolls around which the sheet is wound, the sheet supply device including: a rotation member that is rotatably supported about a predetermined rotation shaft; a plurality of support shafts that are each provided at positions away from the rotation shaft of the rotation member in a direction orthogonal to the rotation shaft and support the rolls at center positions thereof; and a joining mechanism that joins a sheet of a standby side roll different from a supply side roll to a sheet of the supply side roll which is supplying the sheet among the rolls supported by the support shafts, in which the rotation member is rotatably supported between a state in which one support shaft is disposed at a mounting position where a new roll is mounted, and a state in which the one support shaft is disposed at a splice position where the standby side roll is supported when the joining mechanism joins the sheets, the joining mechanism includes a pressing roller that presses the sheet of the supply side roll against an outer peripheral surface of the standby side roll and a moving unit that supports the pressing roller such that the pressing roller is configured to approach and move away from the standby side roll supported by the one support shaft disposed at the splice position in a radial direction of the standby side roll, and the moving unit supports the pressing roller such that a center of the pressing roller is movable on a straight line passing through a center of the rotation shaft and a center of the one support shaft disposed at the splice position.

In addition, the present invention provides a sheet supply method for supplying a sheet using the sheet supply device, the sheet supply method including: a mounting step of mounting the standby side roll on the one support shaft mounted on the mounting position; a supply step of supplying a sheet of a supply side roll supported by another support shaft other than the one support shaft, prior to the mounting step or after the mounting step; a splice preparation step of rotating the rotation member such that the one support shaft is disposed at the splice position when a remaining quantity of the sheet of the supply side roll is equal to or less than a preset remaining quantity; and a joining step of pressing the sheet of the supply side roll against an outer peripheral surface of the standby side roll and joining a sheet of the standby side roll to the sheet of the supply side roll by moving the pressing roller such that a center of the pressing roller moves on a straight line passing through a center of the rotation shaft and a center of the one support shaft disposed at the splice position.

According to the present invention, the pressing roller is moved such that the center of the pressing roller is movable on a straight line passing through the center of the rotation shaft and the center of one support shaft disposed at the splice position. Thereby, since the pressing force from the pressing roller can be transmitted to the rotation shaft along the radial direction of the rotation shaft, it is possible to prevent the pressing force from the pressing roller from working in the bending direction of the rotation member supported by the rotation shaft and prevent the rotation member from working in the rotation direction.

Therefore, according to the present invention, the sheets can be accurately joined by accurately transmitting the force for joining the sheets from the pressing roller to the standby side roll.

Here, the sheet of the supply side roll can be pressed against the outer peripheral surface of the standby side roll by moving the pressing roller in the vertical direction. In this case, however, the gravity affects the pressing force (torque) of the pressing roller, such as the need to operate the pressing roller against the self-weight of the pressing roller, so it is difficult to manage the pressing force against the standby side roll by the pressing roller.

Therefore, in the sheet supply device, the center of the rotation shaft, the center of the one support shaft disposed at the splice position, and the center of the pressing roller are preferably disposed in parallel on the same horizontal plane.

In this aspect, since the pressing roller is moved in the horizontal direction, the influence of the self-weight of the pressing roller on the movement of the pressing roller can be reduced.

Therefore, according to the aspect, it is possible to accurately manage the pressing force applied to the standby side roll by the pressing roller.

However, in order to press the sheet of the supply side roll against the outer peripheral surface of the standby side roll, it is necessary to guide the sheet of the supply side roll between the outer peripheral surface of the standby side roll and the pressing roller in the state in which one support shaft is disposed at the splice position. As the specific configuration, it is considered that the guide roller that guides the sheet supplied from the supply side roll between the standby side roll and the pressing roller may be fixed at a position on the standby side roll side of the rotation shaft in the rotation member. However, when such a guide roller is provided on the rotation member near the rotation shaft, the middle part of the sheet guided from the guide roller to the standby side roll may come into contact with the outer peripheral surface of the standby side roll.

Therefore, the sheet supply device further includes a guide roller that is fixed to the rotation member such that the guide roller is disposed above or under the pressing roller on a side closer to the pressing roller than the one support shaft positioned at the splice position and such that the guide roller is disposed outside a circular trajectory drawn by the outer peripheral surface of the standby side roll according to rotation of the rotation member, and guides the sheet such that a direction of the sheet supplied from the supply side roll is changed outside the circular trajectory and the sheet is guided between the pressing roller and the standby side roll.

In this aspect, the sheet from the supply side roll is once guided to a position outside the circular trajectory drawn by the outer peripheral surface of the standby side roll according to the rotation of the rotation member, and then the sheet is guided between the pressing roller and the standby side roll from the guide roller. As a result, it is possible to prevent the middle part of the sheet guided between the pressing roller and the standby side roll from the guide roll from coming into contact with the outer peripheral surface of the standby side roll.

Note that the "trajectory" means a trajectory drawn by a portion positioned farthest from the rotation shaft on the outer peripheral surface of the standby side roll.

In addition, in the sheet supply device, the sheet of the supply side roll is guided between the standby side roll and the pressing roller, the sheet of the supply side roll is joined to the sheet of the standby side roll, and then the sheet of the supply side roll can be cut. Here, when the sheet of the supply side roll is guided between the standby side roll and the pressing roller through the top of the standby side roll, if the sheet of the supply side roll is cut, there is a possibility that the end portion of the sheet is placed on the standby side roll and caught in the standby side roll.

Therefore, the sheet supply device further includes a guide roller that guides the sheet of the supply side roll between the pressing roller and the standby side roll from the supply side roll through the bottom of the standby side roll in the state in which the one support shaft is disposed at the splice position, and a cutter that cuts the sheet of the supply side roll at a position under the center of the standby side roll.

According to this aspect, the sheet of the supply side roll is guided between the standby side roll and the pressing roller through the bottom of the standby side roll, and the sheet of the supply side roll is cut at a position under the center of the standby side roll. Therefore, by making the end portion of the cut sheet of the supply side roll fall under both rolls, it is possible to prevent the sheet of the supply side roll from being caught in the standby side roll.

The sheet supply device further includes a support mechanism that has a shaft support part that supports the rotation shaft, and a unit support part that extends from the shaft support part toward the moving unit and is mounted on a preset mounting surface the moving unit being movably attached to the unit support part, in which the center of the one support shaft disposed at the mounting position is preferably disposed in an area other than an area overlapping with the shaft support part and the unit support part in a side view viewed along the rotation shaft.

According to this aspect, when the standby side roll is mounted on one support shaft in the state in which the supply side roll is supported by another support shaft, it is possible to perform the mounting operation of the standby side roll in a large space away from the shaft support part and the unit support part in a side view.

The invention claimed is:

1. A sheet supply device for sequentially supplying a sheet from a plurality of rolls around which the sheet is wound, the sheet supply device comprising:

a rotation member that is rotatably supported about a predetermined rotation shaft;

a plurality of support shafts that are each provided at positions away from the rotation shaft of the rotation member in a direction orthogonal to the rotation shaft and support the rolls at center positions thereof; and a joining mechanism that joins a sheet of a standby side roll different from a supply side roll to a sheet of the supply side roll which is supplying the sheet among the rolls supported by the support shafts, wherein the rotation member is rotatably supported between a state in which one support shaft is disposed at a mounting position where a new roll is mounted, and a state in which the one support shaft is disposed at a splice position where the standby side roll is supported when the joining mechanism joins the sheets, the joining mechanism includes a pressing roller that presses the sheet of the supply side roll against an outer peripheral surface of the standby side roll and a moving unit that supports the pressing roller such that the pressing roller is configured to approach and move away from the standby side roll supported by the one support shaft disposed at the splice position in a radial direction of the standby side roll, and the moving unit supports the pressing roller such that a center of the pressing roller is movable on a straight line passing through a center of the rotation shaft and a center of the one support shaft disposed at the splice position.

2. The sheet supply device according to claim 1, wherein the center of the rotation shaft, the center of the one support shaft disposed at the splice position, and the center of the pressing roller are disposed in parallel on a same horizontal plane.

3. The sheet supply device according to claim 2, further comprising:

a guide roller that is fixed to the rotation member such that the guide roller is disposed above or under the pressing roller on a side closer to the pressing roller than the one support shaft disposed at the splice position and such that the guide roller is disposed outside a circular trajectory drawn by the outer peripheral surface of the standby side roll according to rotation of the rotation member, and guides the sheet such that a direction of the sheet supplied from the supply side roll is changed outside the circular trajectory and the sheet is guided between the pressing roller and the standby side roll.

4. The sheet supply device according to claim 3, further comprising:

a support mechanism that has a shaft support part that supports the rotation shaft, and a unit support part that extends from the shaft support part toward the moving unit and is mounted on a preset mounting surface, the moving unit being movably attached to the unit support part, wherein the center of the one support shaft disposed at the mounting position is disposed in an area other than an area overlapping with the shaft support part and the unit support part in a side view viewed along the rotation shaft.

5. The sheet supply device according to claim 2, further comprising:

a guide roller that guides the sheet of the supply side roll between the pressing roller and the standby side roll from the supply side roll through a bottom of the standby side roll in the state in which the one support shaft is disposed at the splice position, and a cutter that cuts the sheet of the supply side roll at a position under the center of the standby side roll.

6. The sheet supply device according to claim 5, further comprising:

a support mechanism that has a shaft support part that supports the rotation shaft, and a unit support part that extends from the shaft support part toward the moving unit and is mounted on a preset mounting surface, the moving unit being movably attached to the unit support part, wherein the center of the one support shaft disposed at the mounting position is disposed in an area other than an area overlapping with the shaft support part and the unit support part in a side view viewed along the rotation shaft.

7. The sheet supply device according to claim 2, further comprising:

a support mechanism that has a shaft support part that supports the rotation shaft, and a unit support part that extends from the shaft support part toward the moving unit and is mounted on a preset mounting surface, the moving unit being movably attached to the unit support part, wherein the center of the one support shaft disposed at the mounting position is disposed in an area other than an area overlapping with the shaft support part and the unit support part in a side view viewed along the rotation shaft.

8. A sheet supply method for supplying a sheet using the sheet supply device according to claim 1, the sheet supply method comprising:

a mounting step of mounting the standby side roll on the one support shaft mounted on the mounting position;

a supply step of supplying a sheet of a supply side roll supported by another support shaft other than the one support shaft, prior to the mounting step or after the mounting step;

a splice preparation step of rotating the rotation member such that the one support shaft is disposed at the splice position when a remaining quantity of the sheet of the supply side roll is equal to or less than a preset remaining quantity; and a joining step of pressing the sheet of the supply side roll against an outer peripheral surface of the standby side roll and joining a sheet of the standby side roll to the sheet of the supply side roll by moving the pressing roller such that a center of the pressing roller moves on a straight line passing through a center of the rotation shaft and a center of the one support shaft disposed at a splice position.

* * * * *